US010916875B2

(12) United States Patent
Teruki

(10) Patent No.: US 10,916,875 B2
(45) **Date of Patent: *Feb. 9, 2021**

(54) CONNECTOR AND CONNECTOR ASSEMBLY

(71) Applicant: Molex, LLC, Lisle, IL (US)

(72) Inventor: Satoru Teruki, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/815,015

(22) Filed: Mar. 11, 2020

(65) Prior Publication Data

US 2020/0212615 A1 Jul. 2, 2020

Related U.S. Application Data

(63) Continuation of application No. 15/981,253, filed on May 16, 2018, now Pat. No. 10,608,361.

(30) Foreign Application Priority Data

May 19, 2017 (JP) ..... 2017-100127
Mar. 12, 2018 (JP) ..... 2018-044094

(51) Int. Cl.
*H01R 12/00* (2006.01)
*H01R 13/24* (2006.01)
(Continued)

(52) U.S. Cl.
CPC ..... *H01R 13/2407* (2013.01); *H01R 12/91* (2013.01); *H01R 13/424* (2013.01);
(Continued)

(58) Field of Classification Search
CPC .. H01R 9/096; H01R 23/725; H01R 13/6315; H01R 23/7068; H01R 23/7073; H05K 7/1069; H05K 7/1084
(Continued)

(56) References Cited

U.S. PATENT DOCUMENTS 7,354,279 B2 4/2008 Uesaka
7,637,762 B2 12/2009 Ryo
(Continued)

FOREIGN PATENT DOCUMENTS

CN 102427177 A 4/2012
CN 104347991 A 2/2015
(Continued)

OTHER PUBLICATIONS

Non-Final rejection received for U.S. Appl. No. 15/981,253, dated Dec. 26, 2018, 7 pages.
(Continued)

*Primary Examiner* — Thanh Tam T Le

(57) ABSTRACT

A connection to which a mating connector, moving from one side to another side in a first direction, may be able to be inserted, and may include an inner housing, an outer housing surrounding the inner housing, and a plurality of terminals connecting these housings. The terminals may each include an inner fixed portion fixed to the inner housing, an outer fixed portion fixed to the outer housing, and an elastic portion that is connected to both the inner fixed portion and the outer fixed portion and is elastically deformable. The outer fixed portion may include a first base portion connected to the elastic portion and a first engaging portion that extends in a direction crossing the first direction from the first base portion and is engaged with the outer housing.

25 Claims, 15 Drawing Sheets

(51) Int. Cl.

| | |
|---|---|
| ***H01R 13/424*** | (2006.01) |
| ***H01R 13/506*** | (2006.01) |
| ***H01R 12/91*** | (2011.01) |
| *H01R 13/41* | (2006.01) |
| *H01R 13/502* | (2006.01) |
| *H01R 12/73* | (2011.01) |

(52) U.S. Cl.
CPC ..... *H01R 13/506* (2013.01); *H01R 12/73* (2013.01); *H01R 13/41* (2013.01); *H01R 13/502* (2013.01)

(58) Field of Classification Search
USPC ..... 439/65, 70, 71, 74, 247, 248, 637, 660
See application file for complete search history.

(56) References Cited

U.S. PATENT DOCUMENTS

| | | | | |
|---|---|---|---|---|
| 7,828,559 | B2 | 11/2010 | Chen et al. | |
| 7,845,958 | B2 | 12/2010 | Hoshino et al. | |
| 7,901,218 | B2 | 3/2011 | Sato et al. | |
| 8,678,838 | B2 | 3/2014 | Kim et al. | |
| 9,022,811 | B2 * | 5/2015 | Takaki ..... | H01R 12/70 439/637 |
| 9,033,722 | B2 * | 5/2015 | Kobayashi ..... | H01R 12/712 439/248 |
| 9,088,113 | B2 * | 7/2015 | Funayama ..... | H01R 12/91 |
| 9,178,326 | B2 * | 11/2015 | Funayama ..... | H01R 12/91 |
| 9,190,753 | B2 * | 11/2015 | Takaki ..... | H01R 12/716 |
| 9,225,089 | B2 * | 12/2015 | Sato ..... | H01R 4/028 |
| 9,287,654 | B2 * | 3/2016 | Takaki ..... | H01R 13/52 |
| 9,917,403 | B2 | 3/2018 | Doi | |
| 10,062,995 | B2 * | 8/2018 | Doi ..... | H01R 13/6315 |
| 10,208,361 | B2 * | 2/2019 | Junker ..... | B23P 15/00 |
| 10,608,361 | B2 * | 3/2020 | Teruki ..... | H01R 13/2407 |
| 2010/0159749 | A1 | 6/2010 | Ohkuma | |
| 2015/0064935 | A1 | 3/2015 | Funayama et al. | |

FOREIGN PATENT DOCUMENTS

| | | | |
|---|---|---|---|
| CN | 104425925 | A | 3/2015 |
| CN | 206076547 | A | 4/2017 |
| JP | 2014-067723 | A | 4/2014 |

OTHER PUBLICATIONS

Non-Final rejection received for U.S. Appl. No. 15/981,253, dated Aug. 14, 2019, 7 pages.

* cited by examiner

CONNECTOR AND CONNECTOR ASSEMBLY

RELATED APPLICATIONS

This application is a continuation of U.S. application Ser. No. 15/981,253, filed May 16, 2018, which in turn claims priority to each of Japanese Application No. 2017-100127, filed May 19, 2017 and Japanese Patent Application No. 2018-044094, filed Mar. 12, 2018, all of which are incorporated herein by reference in their entirety.

TECHNICAL FIELD

The present disclosure relates to a connector and a connector assembly.

BACKGROUND ART

A floating connector mounted on a surface of a circuit board is disclosed in Patent Document 1 described below. The floating connector includes an inner housing and an outer housing that surrounds the inner housing in a front and back direction and a right and left direction. A plurality of terminals, including conductor plates made of metal and the like, are attached to each of the inner housing and the outer housing. The terminals attached to the floating connector each include an inner fixed portion (a first fixed piece portion 23e in Patent Document 1) fixed to the inner housing, an outer fixed portion (a second fixed piece portion 23g in Patent Document 1) fixed to the outer housing, and an elastic portion (a movable portion 23f in Patent Document 1) that is bent to be in an inversed V shape and is interposed between the inner and the outer fixed portions. Each of the plurality of terminals, attached to the floating connector, elastically deforms at the elastic portions, so that when a mating connector is inserted, misalignment of relative positions of two connectors can be tolerated. In other words, even in a case where the position of the mating connector being inserted is misaligned with the floating connector, the position of the inner housing of the floating connector moves in accordance with the mating connector, whereby the mating connector is successfully inserted to the floating connector.

Patent Document 1: JP 2014-067723 A

SUMMARY

In the terminals disclosed in Patent Document 1 described above, the fixed portion to the outer housing extends upward from a portion to be soldered to a substrate (substrate connection portion) and separates from the elastic portion in the width direction of the connector. This arrangement hinders downsizing of the terminals and the connector attached thereto.

A first object of the present disclosure is to provide a connector and a connector assembly that can tolerate misalignment of a mating connector to be inserted and can achieve a smaller size. A second object of the present disclosure is to provide a connector and a connector assembly that can tolerate larger misalignment of relative positions.

A connector according to the present disclosure is a connector into which a mating connector is insertable from a first side toward a second side on a side opposite to the first side in a first direction, and may include an inner housing, an outer housing that is disposed more on an outer side than the inner housing in a direction perpendicular to the first direction and surrounds the inner housing, and a plurality of terminals that couple the inner housing and the outer housing. The terminals may each include an inner fixed portion fixed to the inner housing, a contact portion that is connected to the inner fixed portion and comes into contact with a mating terminal of the mating connector, an outer fixed portion fixed to the outer housing, a substrate-fixed portion that is connected to the outer fixed portion and is fixed to a substrate, and an elastic portion that is connected to both the inner fixed portion and the outer fixed portion and is elastically deformable. The outer fixed portion may include a first base portion that is connected to the elastic portion, and a first engaging portion that extends in a direction crossing the first direction from the first base portion and engages with the outer housing. This configuration can tolerate misalignment of the mating connector to be inserted. This configuration can also achieve downsizing of the connector.

In the connector according to one aspect, the first base portion and the first engaging portion may be arranged to be in an L shape in the terminals as viewed in the first direction.

In the connector according to one aspect, the inner fixed portion may include a second base portion that is connected to the elastic portion, and a second engaging portion that extends in a direction crossing the first direction from the second base portion and engages with the inner housing.

In the connector according to one aspect, the second base portion and the second engaging portion may be arranged to be in an L shape in the terminals as viewed in the first direction.

In the connector according to one aspect, the contact portion may extend toward the first side from the second engaging portion.

In the connector according to one aspect, the elastic portion may include a first extending portion that extends toward the first side from the first base portion, a second extending portion that extends toward the first side from the inner fixed portion, and a curved portion that connects the first extending portion and the second extending portion to each other. At least one of a part of the first extending portion and a part of the curved portion may be disposed more on the outer side than the first base portion.

In the connector according to one aspect, the first extending portion may include an inclined portion that diagonally extends toward the first side and toward the outer side from the first base portion, and a linear portion that extends toward the first side from the inclined portion and is connected to the curved portion.

In the connector according to one aspect, at least a part of the first engaging portion may be disposed more on the outer side than the first extending portion and the curved portion.

In the connector according to one aspect, an end of the elastic portion connected to the inner fixed portion may be disposed more on the first side than an end of the elastic portion connected to the outer fixed portion.

A connector assembly according to the present disclosure includes a first connector and a second connector. The first connector is a connector having a first side and a second side on a side opposite to the first side in a first direction and includes an inner housing, an outer housing that is disposed more on an outer side than the inner housing in a direction perpendicular to the first direction and surrounds the inner housing, and a plurality of first terminals that are attached to the inner housing and the outer housing such that the inner housing and the outer housing are coupled to each other. The second connector includes a plurality of second terminals, and is inserted to the first connector from the first side toward the second side. The first terminals may each include a contact portion that comes into contact with a corresponding one of the second terminals, an inner fixed portion fixed to the inner housing, an outer fixed portion fixed to the outer housing, an elastic portion that is connected to both the inner fixed portion and the outer fixed portion and is elastically deformable, and a substrate-fixed portion that is fixed to a substrate. The outer fixed portion may include a first base portion that is connected to the elastic portion, and a first engaging portion that extends in a direction crossing the first direction from the first base portion in the terminals as viewed in the first direction, and engages with the outer housing. The plurality of first terminals may each be electrically connected to a corresponding one of the plurality of second terminals in a state where the second connector is fit to the first connector.

An example of the connector presented in the present disclosure is a connector into which a mating connector is insertable from a first side toward a second side on a side opposite to the first side in a first direction, and includes an inner housing, an outer housing that is disposed more on an outer side than the inner housing in a second direction perpendicular to the first direction, and a plurality of terminals that couple the inner housing and the outer housing. The terminals may each include an outer fixed portion fixed to the outer housing, an inner fixed portion fixed to the inner housing, and an elastic portion that is elastically deformable. The elastic portion includes a first extending portion that extends toward the first side from the outer fixed portion, a second extending portion that extends toward the first side from the inner fixed portion, and a curved portion that is bent between the first extending portion and the second extending portion. Furthermore, each of the terminals includes a first connection portion that is a connection portion between the outer fixed portion and the first extending portion, and a second connection portion that is a connection portion between the inner fixed portion and the second extending portion. The second connection portion may be disposed more on the first side than the first connection portion, the first extending portion may include a portion disposed in the second direction relative to the second connection portion, and the portion of the first extending portion may be disposed more on the outer side in the second direction than the first connection portion. With this connector, larger misalignment of relative positions of two connectors can be tolerated.

In this connector, the first extending portion may include an inclined portion that diagonally extends toward the outer side in the second direction and toward the first side from the first connection portion.

In this connector, the first extending portion may be bent from the inclined portion and extend in the first direction toward the first side.

An end of the inclined portion may be disposed more on the second side than the second connection portion in the first direction, or may be disposed at the same position as the second connection portion in the first direction.

An example of the connector assembly presented in the present disclosure includes a first connector and a second connector. The first connector is a connector having a first side and a second side on a side opposite to the first side in a first direction and includes an inner housing, an outer housing that is disposed more on an outer side than the inner housing in a second direction perpendicular to the first direction, and a plurality of first terminals that couple the inner housing and the outer housing. The second connector includes a plurality of second terminals, and is inserted to the first connector from the first side of the first connector toward the second side. Each of the first terminals includes an outer fixed portion fixed to the outer housing, an inner fixed portion fixed to the inner housing, an elastic portion that is elastically deformable, a first connection portion that is a connection portion between the outer fixed portion and the first extending portion, and a second connection portion that is a connection portion between the inner fixed portion and the second extending portion. The elastic portion includes a first extending portion that extends toward the first side from the outer fixed portion, a second extending portion that extends toward the first side from the inner fixed portion, and a curved portion that is bent between the first extending portion and the second extending portion. The second connection portion is disposed more on the first side than the first connection portion, the first extending portion includes a portion disposed in the second direction relative to the second connection portion, and the portion of the first extending portion is disposed more on the outer side in the second direction than the first connection portion. With this connector assembly, larger misalignment of relative positions of two connectors can be tolerated.

DETAILED DESCRIPTION OF THE PREFERRED EMBODIMENTS

Figure 1:
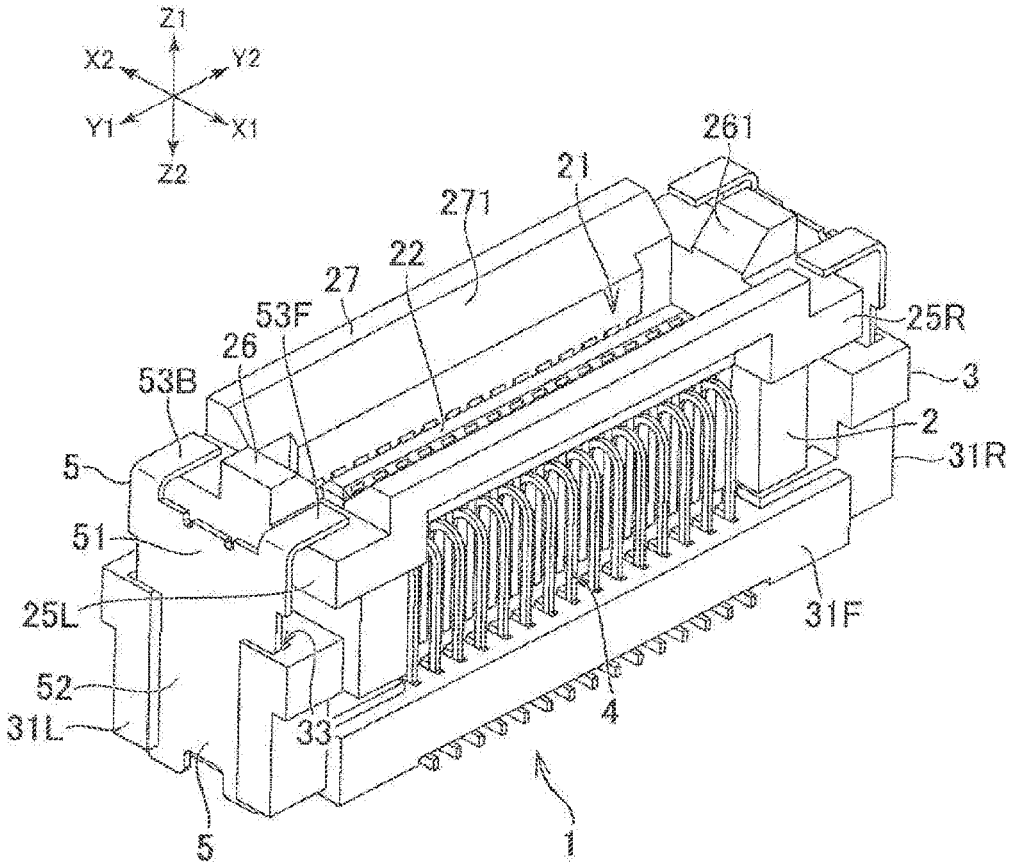
FIG. 1 is a perspective view illustrating a connector according to the present disclosure.

In the present embodiment, the direction indicating the height of a connector 1 includes a direction in which the connector 1 is attached to a mating connector 9 (a Z1 direction in the drawings) defined as an upper side and a direction in which the connector 1 is pulled out from the mating connector (a Z2 direction in the drawings) defined as a lower side. A short-side direction of the connector 1 has one side (an X1 direction in the drawings) defined as a front side and the other side (an X2 direction in the drawings) defined as a back side. A longitudinal direction of the connector 1 has one side (a Y1 direction in the drawings)

defined as a left side and the other side (a Y2 direction in the drawings) defined as a right side. Note that the various directions are only used to describe the relative positional relationships of the parts that configure the connector 1, and thus do not illustrate absolute directions.

Figure 4:
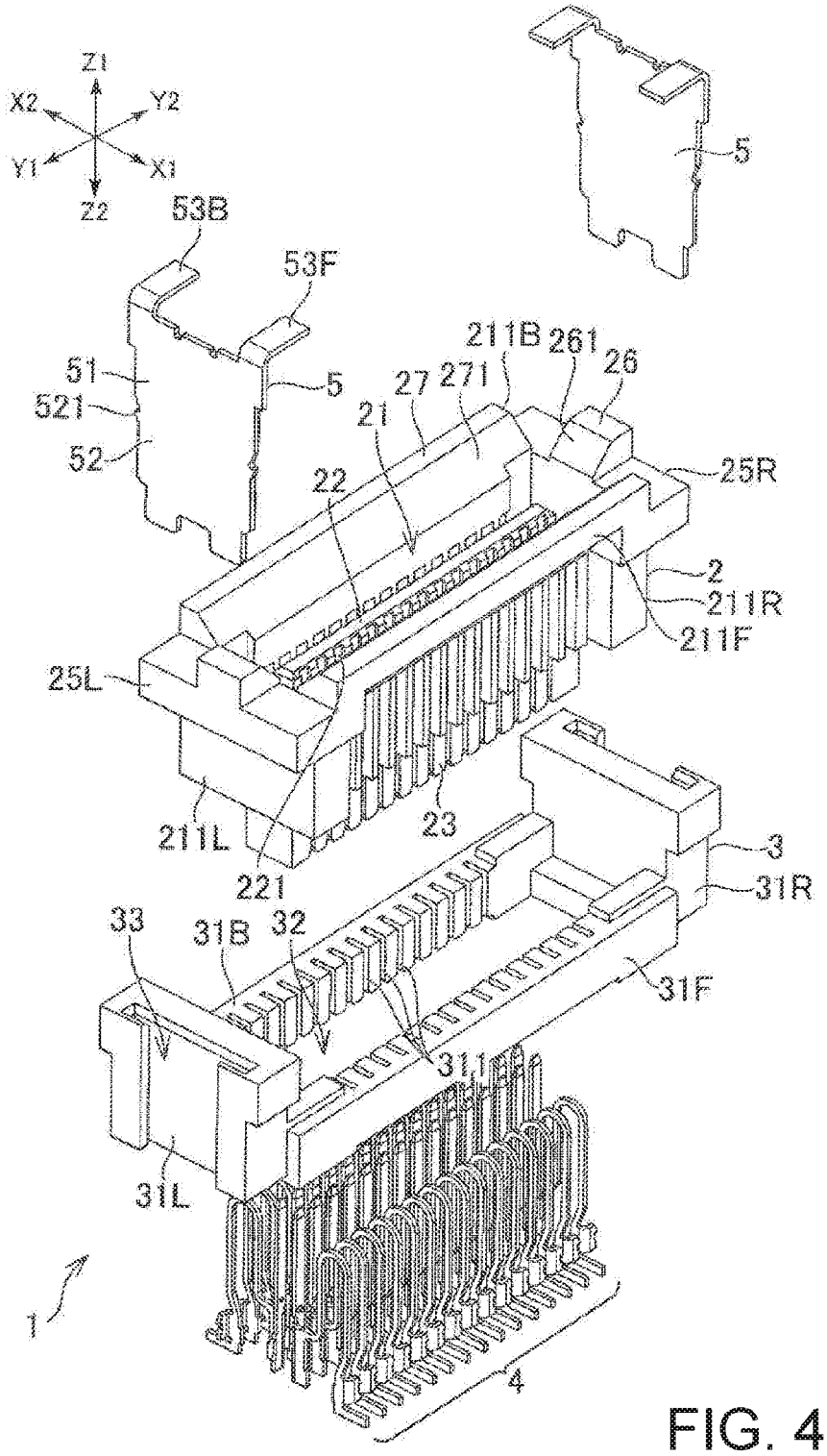
FIG. 4 is an exploded perspective view illustrating components of the connector.

As illustrated in FIGS. 1 and 4, the connector 1 according to the present embodiment includes an inner housing 2, an outer housing 3, a plurality of terminals 4, and a pair of supporting jigs 5. The inner housing 2 and the outer housing 3 may be formed of an insulating material such as resin, plastic, and carbon fiber. The terminals 4 may be made of a conducting material such as metal. The supporting jigs 5 may be made of a bendable material such as metal. Note that the components of the connector 1 and the materials of the components are not necessarily limited to these.

Figure 7:
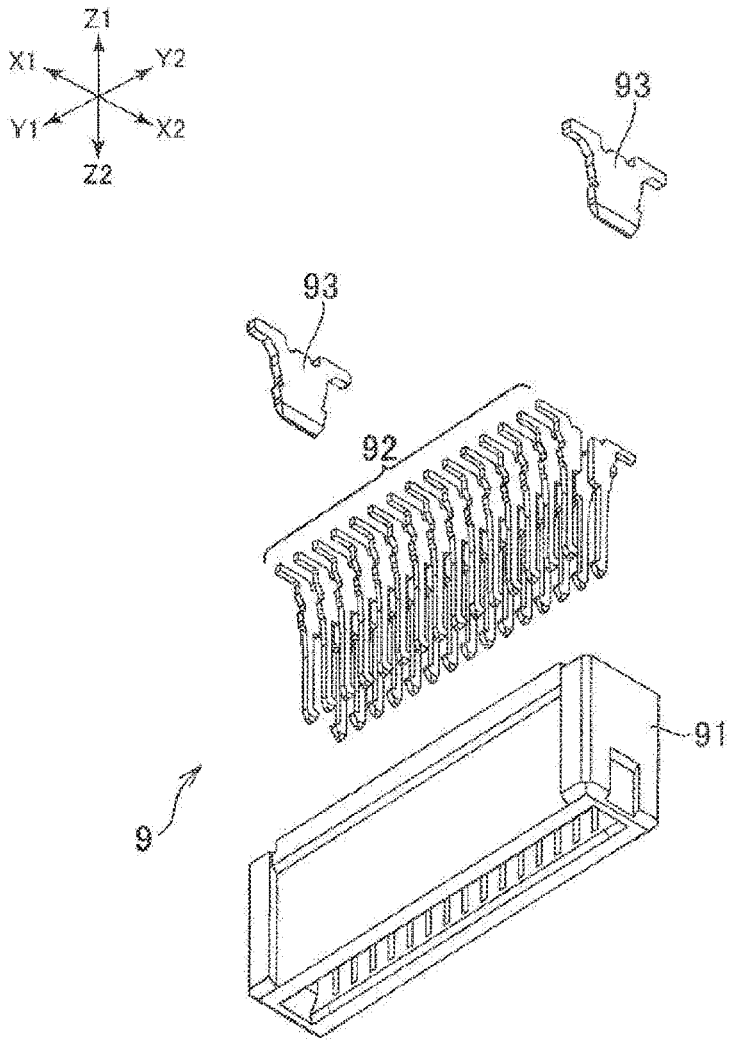
FIG. 7 is an exploded perspective view illustrating components of a mating connector.

As illustrated in FIG. 7, the mating connector 9, attached to the connector 1, may include a housing 91 having a substantially rectangular tube shape, a plurality of terminals 92 contained inside the housing 91, and a pair of fixing jigs 93. As in the case of the components of the connector 1, the housing 91 may be made of resin and the like, and the terminal 92 and the fixing jigs 93 may be made of metal and the like. Note that the shape and the components of the mating connector 9 and the materials of the components are not necessarily limited to these. For example, the housing 91 may have a cylindrical shape.

As illustrated in FIG. 4, the inner housing 2 of the connector 1 may include a connector containing portion 21 that is a space for containing the mating connector 9. The connector 1 may have what is known as a floating function. Specifically, the mating connector 9 is containable in the connector containing portion 21 even when the relative positions of the connector 1 and the mating connector 9 are misaligned to some extent, with the plurality of terminals 4 elastically deforming and the inner housing 2 moving in the front and back direction and in the right and left direction.

Figure 2:
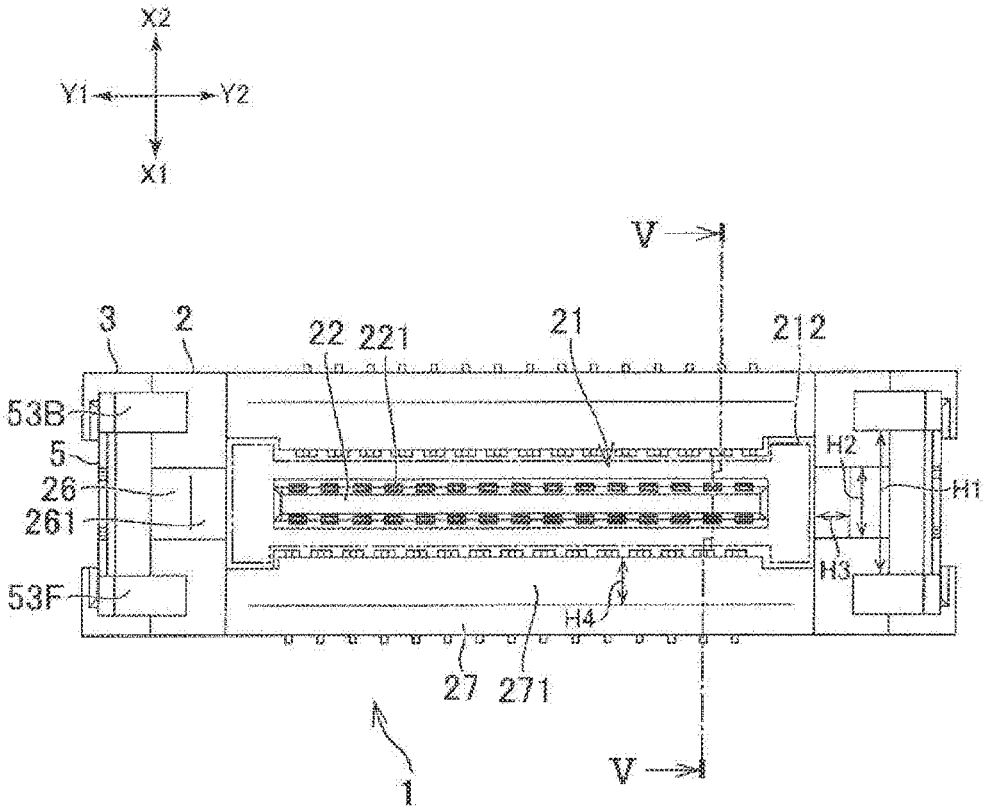
FIG. 2 is an upper view illustrating the connector.

As illustrated in FIG. 4, the inner housing 2 may have a substantially box shape, and include a front wall portion 211F and a back wall portion 211B that extend in the right and left direction as well as a left wall portion 211L and a right wall portion 211R extending in the front and back direction. The connector containing portion 21 is a space surrounded by the front wall portion 211F, the back wall portion 211B, the left wall portion 211L, and the right wall portion 211R, for example. As illustrated in FIG. 2, the connector containing portion 21 may have an upper opening 212 having a substantially rectangular shape. The connector 1 and the mating connector 9 may be fit to each other with the mating connector 9 inserted in the upper opening 212. Note that the shape of the inner housing 2 and the disposed position of the connector containing portion 21 are not necessarily limited to these. For example, the inner housing 2 may have a circular shape or the like in an upper view of the connector 1. The upper opening 212 of the inner housing 2 may also have a circular shape or the like.

As illustrated in FIG. 4, the connector containing portion 21 may have an inner side provided with a center wall portion 22 extending in the right and left direction. In the present embodiment, the center wall portion 22 is positioned to be separated from the front wall portion 211F, the back wall portion 211B, the left wall portion 211L, and the right wall portion 211R. The center wall portion 22 may have a front surface and a back surface each provided with a plurality of groove portions 221 extending in the upper and lower direction. The plurality of groove portions 221 may each receive a corresponding one of the plurality of terminals 4. Note that the shape and the disposed position of the center wall portion 22 are not necessarily limited to these.

Figure 3A:
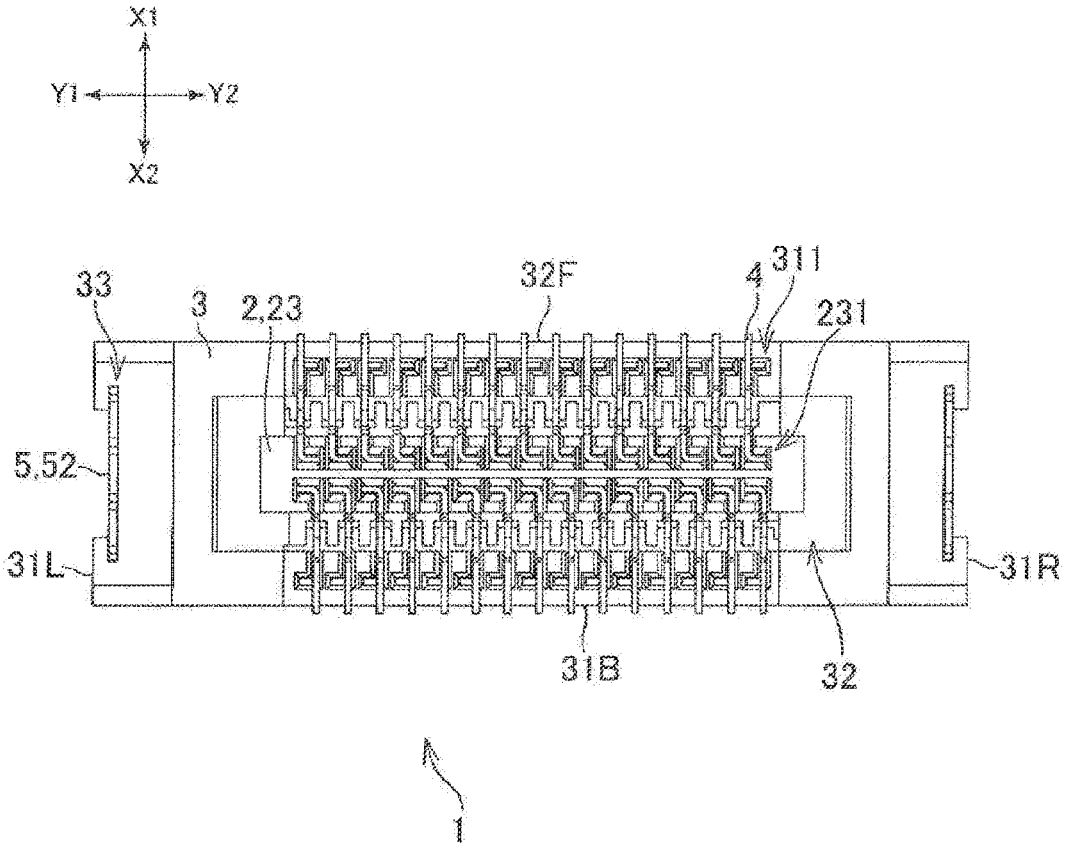
FIG. 3A is a lower view illustrating the connector.
Figure 3B:
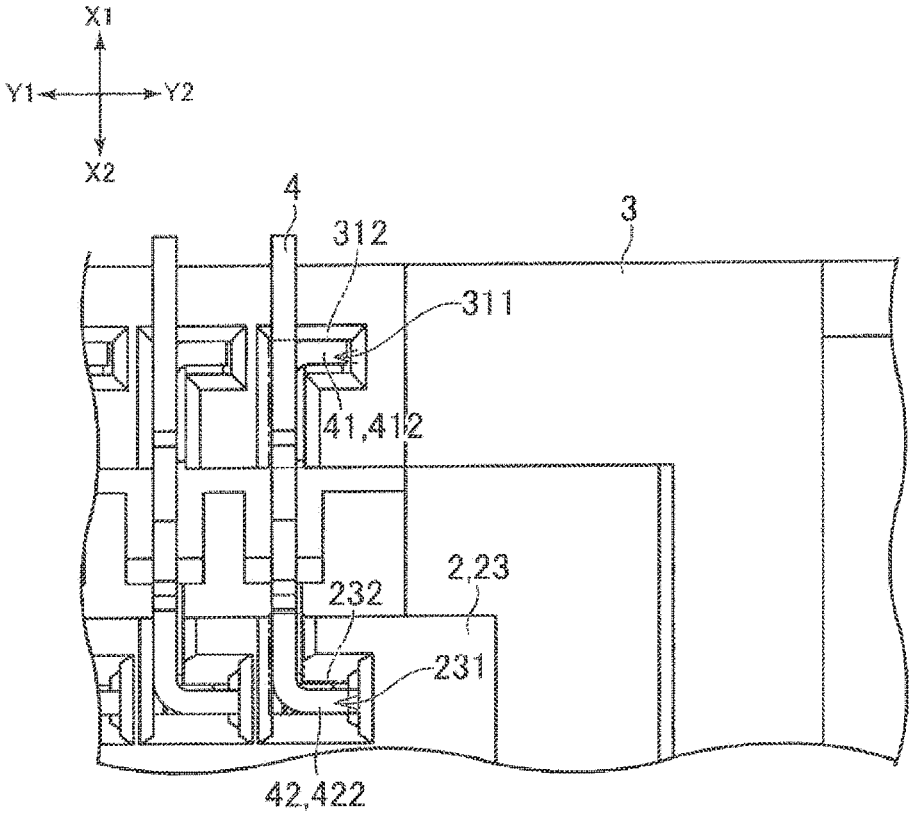
FIG. 3B is an enlarged lower view illustrating the connector illustrated in FIG. 3A.
Figure 5:
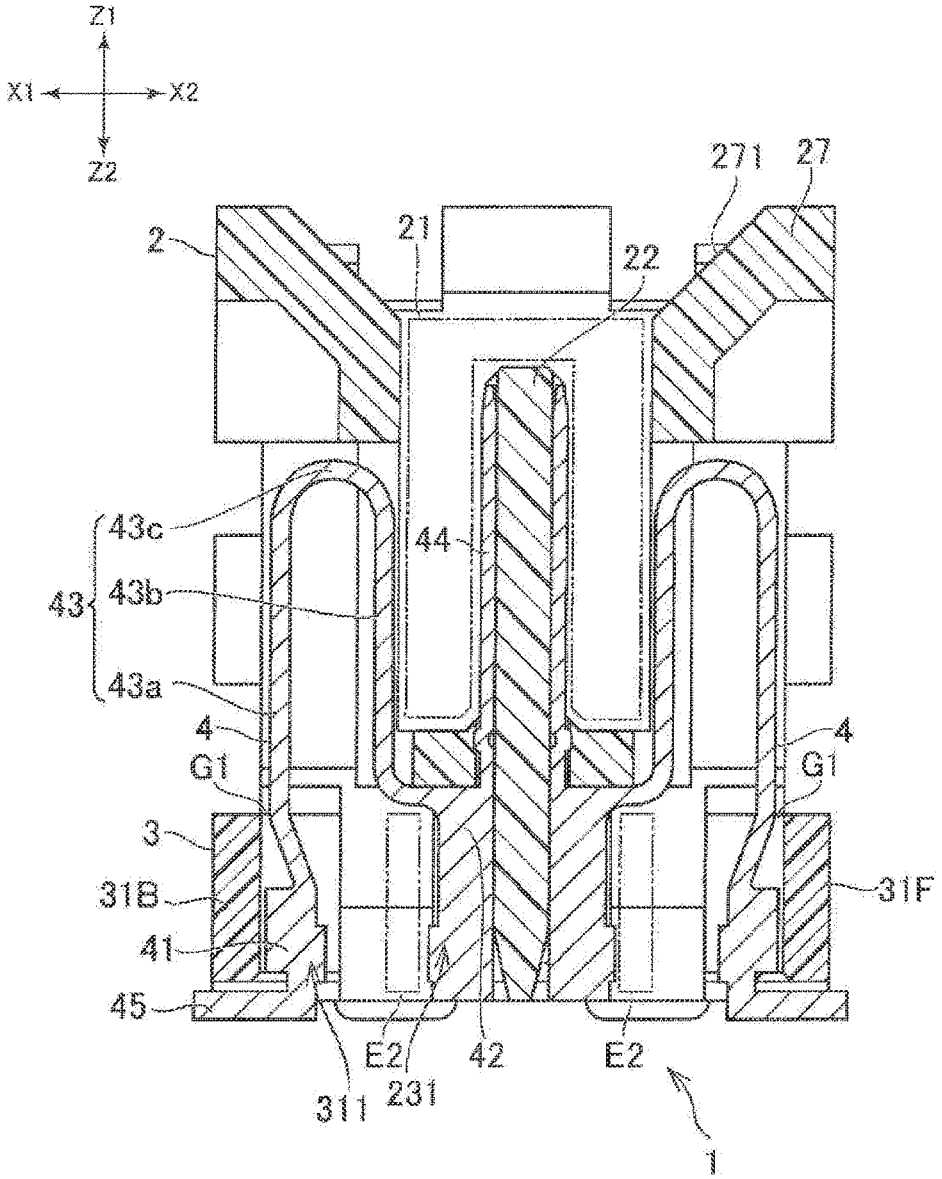
FIG. 5 is a cross-sectional view of the connector, taken along line V-V in FIG. 2.

As illustrated in FIG. 4, the inner housing 2 may have attachment portions 23. The plurality of terminals 4 are each attached to a corresponding one of the attachment portions 23. The attachment portions 23 are formed below the center wall portion 22, for example. In the present embodiment, the attachment portions 23 each extend in the right and left direction and are thicker than the center wall portion 22 in the front and back direction. Note that the shape of the attachment portions 23 is not limited to this. As illustrated in FIG. 3A, FIG. 3B, and FIG. 5, a plurality of terminal containing portions 231 that each contain a corresponding one of the plurality of terminals 4 may be formed on the attachment portions 23. The terminal containing portions 231 are grooves or holes extending in the upper and lower direction. As illustrated in FIG. 3B, the attachment portions 23 may have lower surfaces provided with a plurality of lower openings 232 each in communication with a corresponding one of the plurality of terminal containing portions 231.

As illustrated in FIG. 4, half of the plurality of terminals 4 may be arranged in the right and left direction along a front row of the inner housing 2 and the remaining half of the plurality of terminals 4 may be arranged in the right and left direction along a back row of the inner housing 2. In this case, as illustrated in FIG. 3A and FIG. 3B, the terminal containing portions 231 and the lower openings 232 of the inner housing 2 are also arranged in two rows. In the present embodiment, the lower openings 232 each have a substantially L shape to conform with the shape of an inner fixed portion 42, formed on each of the terminals 4, described later. Note that the shape of the lower openings 232 is not necessarily limited to this, and may be a T shape or a rectangular shape, for example.

As illustrated in FIG. 1 and FIG. 4, the outer housing 3 may be positioned on the outer side of the inner housing 2 in the front and back direction and in the right and left direction, to surround the inner housing 2. As illustrated in FIG. 4, the outer housing 3 may include a front wall portion 31F and a back wall portion 31B respectively disposed on front and back sides of the inner housing 2, and a left wall portion 31L and a right wall portion 31R respectively disposed on left and right sides of the inner housing 2. The front wall portion 31F and the back wall portion 31B may each be connected to the left wall portion 31L and the right wall portion 31R. A housing containing portion 32 that is a space for containing the inner housing 2 may be positioned inside these wall portions 31F, 31B, 31L, and 31R to be surrounded by the wall portions 31F, 31B, 31L, and 31R. As illustrated in FIG. 3A, in the present embodiment, the housing containing portion 32 is provided as a hole with rectangular openings on upper and lower sides. The size of the opening of the housing containing portion 32 is larger than the size of the attachment portions 23 of the inner housing 2, in lower view of the connector 1. Thus, the inner housing 2 can move inside the housing containing portion 32 in the right and left direction and the front and back direction. Note that the shape of the outer housing 3 is not necessarily limited to this. For example, the outer housing 3 may have a box shape with an upper opening, and the housing containing portion 32 may be provided in this box. Alternatively, the outer housing 3 may have a circular shape in an upper view of the connector 1, for example. In this case, the housing containing portion 32 may have a circular shape.

As illustrated in FIG. 5, the front wall portion 31F and the back wall portion 31B of the outer housing 3 may be provided with a plurality of terminal containing portions 311 each receiving a corresponding one of the plurality of terminals 4. The terminal containing portions 311 may be formed as grooves or holes extending in the upper and lower direction. As illustrated in FIG. 3B, the front wall portion 31F and the back wall portion 31B may have lower surfaces provided with a plurality of lower openings 312 each in communication with a corresponding one of the plurality of terminal containing portions 311. In the present embodiment, the lower openings 312 of the outer housing 3 each have a substantially L shape to conform with the shape of an outer fixed portion 41, formed on each of the terminals 4, described later. Note that the shape of the lower openings 312 of the outer housing 3 is not necessarily limited to this.

Next, the plurality of terminals 4 attached to the connector 1 are described. As illustrated in FIG. 5, the inner housing 2 and the outer housing 3 may be coupled to each other via the plurality of terminals 4. The terminals 4 may each include the outer fixed portion 41 fixed to the corresponding terminal containing portion 311 of the outer housing 3, the inner fixed portion 42 fixed to the corresponding terminal containing portion 231 of the inner housing 2, and an elastic portion 43 that is connected to the inner fixed portion 42 and the outer fixed portion 41 and is elastically deformable.

Figure 6A:
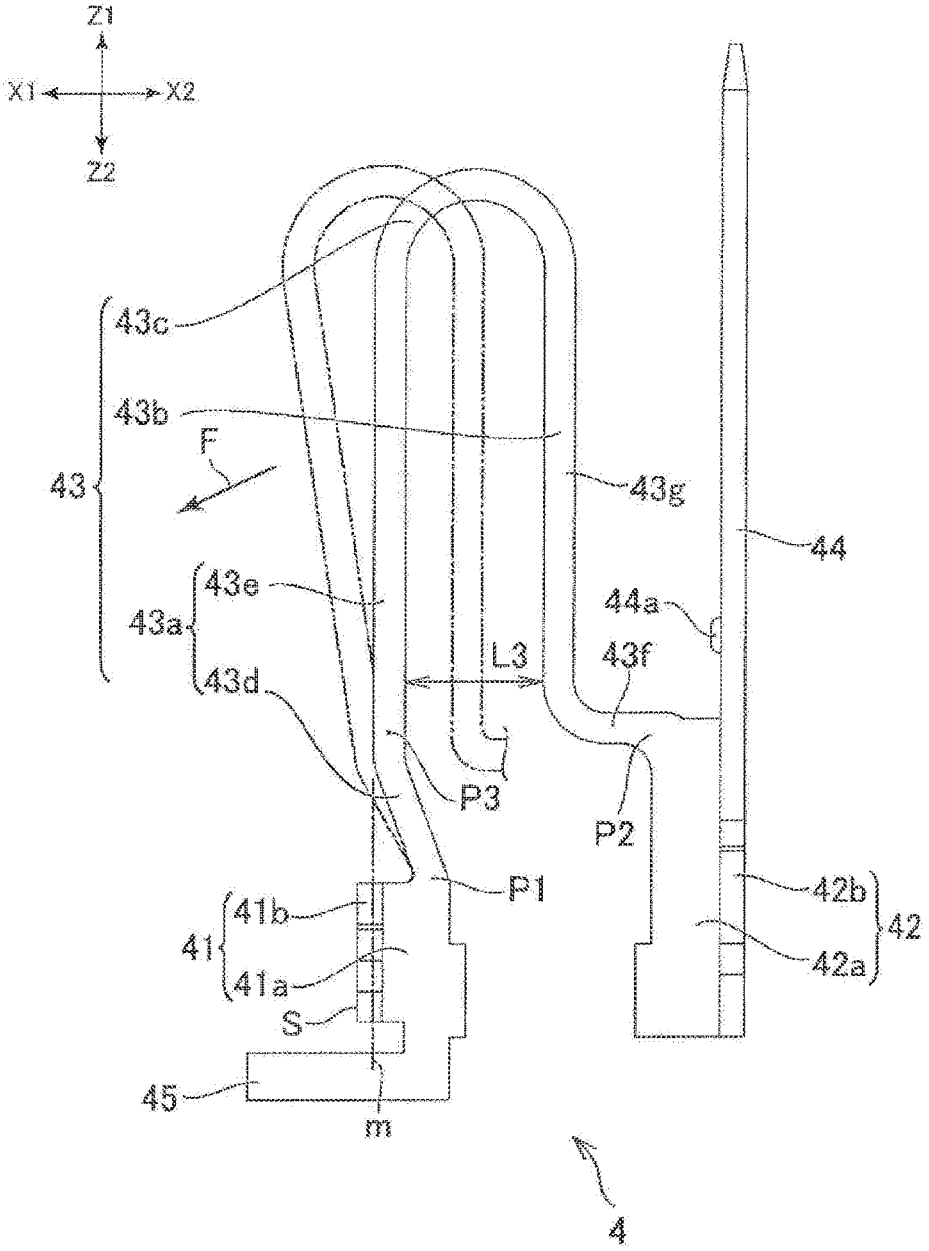
FIG. 6A is a front view illustrating a terminal.
Figure 6B:
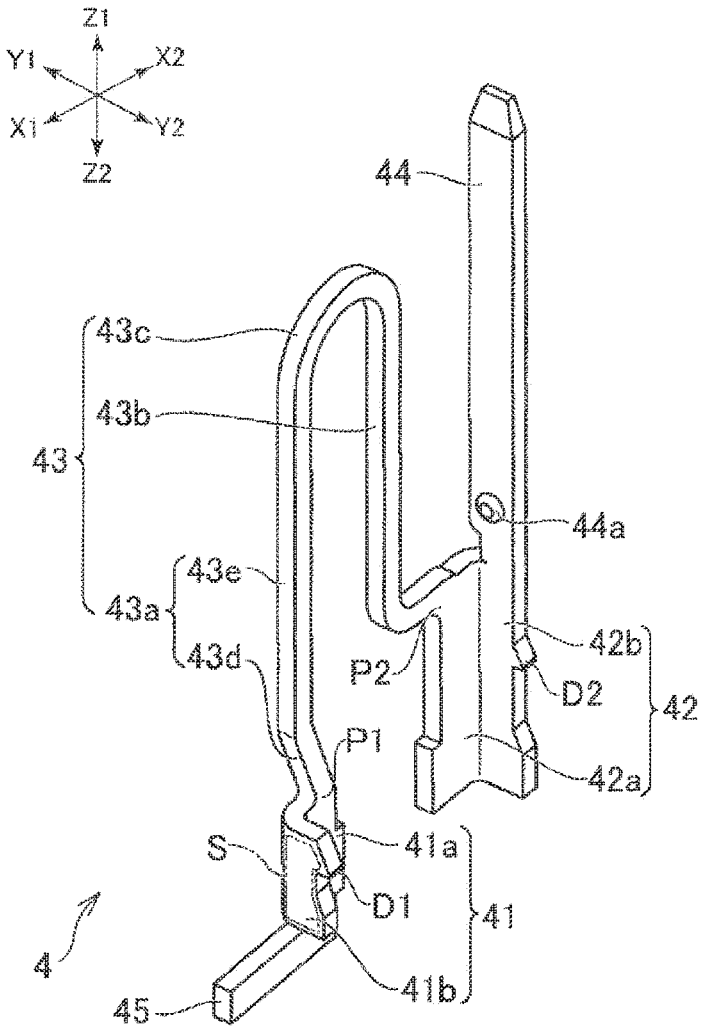
FIG. 6B is a perspective view illustrating the terminal.

As illustrated in FIG. 5, FIG. 6A, and FIG. 6B, the outer fixed portion 41 fixed to the corresponding terminal containing portion 311 of the outer housing 3 may include a first base portion 41*a* connected to the elastic portion 43 and a first engaging portion 41*b* that extends in a direction crossing the upper and lower direction from the first base portion 411 and is engaged with the outer housing 3. In the present disclosure, the first engaging portion 41*b* is a portion of the terminal 4 having a distal end that is hooked on the outer housing 3, and the first base portion 41*a* is a portion of the terminal 4 that is connected to the first engaging portion 41*b* and the elastic portion 43. The terminal 4 may be formed by punching a conducting material having a flat plate shape (specifically, a metal plate), and the first engaging portion 41*b* may be formed as a portion bent relative to the first base portion 41*a*. Alternatively, for example, the terminal 4 may be formed by bending a conducing material, having a wire shape, at a position corresponding to the elastic portion 43.

The first engaging portion 41*b* may extend in a direction crossing the first base portion 41*a* extending in the upper and lower direction (that is, a Z axis direction). In the present embodiment, the first base portion 41*a* and the first engaging portion 41*b* are arranged to be in an L shape in the terminal 4 as viewed in the upper and lower direction (more specifically, in a lower view of the terminal 4). More specifically, the first base portion 41*a* extends in a direction toward the outer side of the outer housing 3 from a connection portion P1 (hereinafter referred to as "first connection portion") between the first base portion 41*a* and the elastic portion 43 (that is, in a direction away from the inner housing 2). In FIG. 6A and FIG. 6B, the first base portion 41*a* extends in the front and back direction (that is, in an X axis direction). In other words, the connection portion P1 between the first base portion 41*a* and the elastic portion 43 is at an end of the first base portion 41*a* in the X axis direction (on the front or back side). The first engaging portion 41*b* extends in a direction orthogonal to the upper and lower direction from an end of the first base portion 41*a* that is on a side opposite to the first connection portion P1. In FIG. 6A and FIG. 6B, the first engaging portion 41*b* extends in the right and left direction (that is, a Y axis direction). The first engaging portion 41*b* may be formed as a portion bent relative to the first base portion 41*a*. An angle between the first base portion 41*a* and the first engaging portion 41*b*, which is substantially a right angle in the present embodiment, may alternatively be an acute or obtuse angle.

As illustrated in FIG. 6, the inner fixed portion 42 contained in the corresponding terminal containing portion 231 of the inner housing 2 may include a second base portion 42*a* connected to the elastic portion 43 and a second engaging portion 42*b* that extends in a direction crossing the upper and lower direction from the second base portion 42*a* and is engaged with the inner housing 2, as in the case of the outer fixed portion 41. The second engaging portion 42*b* may extend in a direction crossing the upper and lower direction (that is, in the Z axis direction) from the second base portion 42*a*. In the present embodiment, the second base portion 42*a* and the second engaging portion 42*b* are arranged to be in an L shape. More specifically, the second base portion 42*a* extends in a direction toward the center (center in the front and back direction) of the inner housing 2 from a connection portion P2 (hereinafter referred to as "second connection portion") between the second base portion 42*a* and the elastic portion 43. In FIG. 6A and FIG. 6B, the second base portion 42*a* extends in the X axis direction. The second engaging portion 42*b* extends in a direction orthogonal to the upper and lower direction from an end of the second base portion 42*a* that is on a side opposite to the second connection portion P2 (that is, an end in an X2 direction). The second engaging portion 42*b* extends in the same direction as the first engaging portion 41*b*. In FIG. 6A, the second engaging portion 42*b* extends in the Y axis direction, as in the case of the first engaging portion 41*b*. The second engaging portion 42*b* may be formed as a portion bent relative to the second base portion 42*a*, as in the case of the first engaging portion 41*b*. An angle between the second base portion 42*a* and the second engaging portion 42*b* may be a substantially right angle, or may be any other angle.

In this manner, by extending the first engaging portion 41*b* in a direction crossing the first base portion 41*a*, which extends in the upper and lower direction (that is, the Z axis direction), the terminal 4 can be downsized in the front and back direction (that is, the X axis direction), while the size of the elastic portion 43 (for example, a first extending portion 43 described later) (see FIG. 6A) and the distance from a second extending portion 43*b* (see FIG. 6A) are maintained. Thus, the connector 1 can be downsized while ensuring a certain tolerance of misalignment of the mating connector 9. The second engaging portion 42*b* may extend in a direction crossing the second base portion 42*a* extending in the upper and lower direction. This also contributes to the downsizing of the terminal 4 and the connector 1.

As illustrated in FIG. 4, the terminals 4 may be inserted from the lower side with respect to the inner housing 2 and the outer housing 3, to be fixed to the inner housing 2 and the outer housing 3. More specifically, as illustrated in FIG. 3B, the outer fixed portion 41 formed on each of the terminals 4 may be inserted through the lower opening 312, in communication with the terminal containing portion 311 of the outer housing 3, to be disposed in the terminal containing portion 311. Similarly, the inner fixed portion 42 formed on the terminal 4 may be inserted through the lower opening 232, in communication with the terminal containing portion 231 of the inner housing 2, to be disposed in the terminal containing portion 231.

As illustrated in FIG. 6B, in the present embodiment, the first engaging portion 41*b*, extending in the right and left direction (that is, the Y axis direction), has a protruding portion D1 formed to protrude toward a distal end side (the Y2 direction in FIG. 6B) in the right and left direction. The terminal 4 is fixed to the outer housing 3, with the protruding portion D1 hooked on an inner surface of the terminal containing portion 311 (a surface of the terminal containing portion 311, illustrated in FIG. 3B, directed in the Y2 direction, for example). As illustrated in FIG. 6B, the second engaging portion 42*b*, extending in the right and left direction, also has a protruding portion D2 formed to protrude toward a distal end side (that is, in the Y2 direction) in the right and left direction. The terminal 4 is fixed to the inner housing 2, with the protruding portion D2 hooked on an inner surface of the terminal containing portion 231 (a surface of the terminal containing portion 231, illustrated in FIG. 3B, directed in the Y2 direction, for example).

Note that the shapes of the first and the second engaging portions 41*b* and 42*b* are not necessarily limited to these. For example, the first and the second engaging portions 41*b* and 42*b* may have a plurality of protruding portions D1 and D2 illustrated in FIG. 6B, or may have no protruding portion D1 or D2 but have flat distal ends. In the latter case, the terminals 4 may be fixed to a corresponding one of the housings with the first and the second engaging portions 41*b* and 42*b* respectively press-fit in the terminal containing portion 311 of the outer housing 3 and the terminal containing portion 231 of the inner housing 2. Alternatively, for example, the first and the second engaging portions 41*b* and 42*b* may each have a side surface (a side surface S of the first engaging portion 41*b* illustrated in FIG. 6B, for example) provided with a protruding portion protruding in the X axis direction. The terminals 4 may each be fixed to a corresponding one of the housings 2 and 3, with these protruding portions hooked on an inner surface of the terminal containing portion 311 (a surface of the terminal containing portion 311, illustrated in FIG. 3B, directed in the X1 direction, for example) and an inner surface of the terminal containing portion 231 (a surface of the terminal containing portion 231, illustrated in FIG. 3B, directed in the X2 direction, for example).

The terminals 4 may each have a contact portion 44 that is connected to the inner fixed portion 42 and comes into contact with a corresponding one of terminals 92 (see FIG. 7) of the mating connector 9. The contact portion 44 may extend in the upper direction from the second engaging portion 42*b*. As illustrated in FIG. 6B, in the present embodiment, the second engaging portion 42*b* is a portion bent from the second base portion 42*a* in the Y axis direction. Thus, the contact portion 44 extending from the second engaging portion 42*b* is formed to be wide in the Y axis direction. This configuration ensures a certain area for bringing the terminals 92 of the mating connector 9 into contact, and thus guarantees electrical connection between the connector 1 and the mating connector 9. A protruding portion 44*a* may be formed on the contact portion 44 through pressing or the like. The protruding portion 44*a* is hooked on an inner surface of a hole formed in the inner housing 2, for example, and thus fixes the terminal 4 to the inner housing 2. Note that the disposed position and the extending direction of the contact portion 44 are not necessarily limited to these.

The terminal 4 may include a substrate-fixed portion 45 connected to the outer fixed portion 41 and fixed to an unillustrated substrate disposed on the lower side of the connector 1. As illustrated in FIG. 6A, the substrate-fixed portion 45 may be disposed at a lower end of the terminal 4, and may extend in a direction toward the outer side of the outer housing 3 (that is, a direction away from the inner housing 2) from the lower end of the first base portion 41*a*. The connector 1 may be fixed on the substrate, with the substrate-fixed portion 45 bonded to the substrate via solder. The substrate-fixed portion 45 may be electrically connected to wiring exposed on a surface of the substrate. In the present embodiment, the substrate-fixed portion 45 is connected to the lower end of the first base portion 41*a* and extends in the front and back direction (the X axis direction in FIG. 6A and FIG. 6B). The first engaging portion 41*b* extends in a direction (the Y axis direction in FIG. 6B) orthogonal to the first base portion 41*a* extending in the upper and lower direction (the Z axis direction in FIG. 6A and FIG. 6B) and the substrate-fixed portion 45 extending in the front and back direction. Note that the shape, the disposed position, and the extending direction of the substrate-fixed portion 45 are not necessarily limited to these.

As illustrated in FIG. 6A and FIG. 6B, the terminals 4 may each include a first extending portion 43*a* that extends in the upper direction from the first base portion 41*a*, a second extending portion 43*b* extending in the upper direction from the second base portion 42*a*, and a curved portion 43*c* that has a substantially arch shape connecting the first and the second extending portions 43*a* and 43*b* to each other. As illustrated in FIG. 6A, a part of the first extending portion 43*a* or a part of the curved portion 43*c* may be disposed more on the outer side (that is, the direction away from the inner housing 2) than the first connection portion P1 between the first base portion 41*a* and the first extending portion 43*a*. In other words, the first extending portion 43*a* has a portion P3 positioned more on the front or back side than the second connection portion P2 (the portion P3 is a portion positioned at the same height as the second connection portion P2). Specifically, the portion P3 is located more on the front side than the second connection portion P2 in the terminal 4 positioned on the front side, whereas the portion P3 is located more on the back side than the second connection portion P2 in the terminal 4 positioned on the back side. The portion P3 is located more on the outer side in the front and back direction than the first connection portion P1. Specifically, the portion P3 is located more on the front side than the first connection portion P1 in the terminal 4 positioned on the front side, whereas the portion P3 is located more on the back side than the first connection portion P1 in the terminal positioned on the back side. This configuration allows for, for example, a larger distance L3 between the first extending portions 43*a* and the second extending portions 43*b* than in the case in which all the curved portions 43*c* and the first extending portions 43*a* are located more on the inner side than the first connection portion P1, in other words, the case in which all the curved portions 43*c* and the first extending portions 43*a* are located closer to the center of the inner housing in the front and back direction than the first connection portion P1. As a result, a larger shift can be tolerated for the inner housing 2 in the front and back direction. In addition, the size of the elastic portion 43 can be increased in the front and back direction. Thus, the terminal 4 and the connector 1 can be downsized while ensuring a certain tolerance for misalignment of the mating connector 9 to be inserted.

In the present embodiment, the first extending portion 43*a* includes an inclined portion 43*d* that diagonally extends in an upper diagonal direction toward the outer side from the first base portion 41*a* and a linear portion 43*e* that extends in the upper direction from the inclined portion 43*d* and is connected to the curved portion 43*e*. The first extending portion 43*a* is bent at a portion where the inclined portion 43*d* and the linear portion 43*e* are connected to each other, whereas the linear portion 43*e* extends straight in the upper direction. In other words, the linear portion 43*e* is formed vertically. With this configuration, the width of the terminal 4 in the front and back direction can be reduced, whereby the connector 1 can be downsized.

As illustrated in FIG. 6A, at least a part of the first engaging portion 41*b* may be disposed more on the outer side in the front and back direction (that is, in the direction away from the inner housing 2) than the first extending portion 43*a*. In the present embodiment, the side surface S of the first engaging portion 41*b* is positioned more on the outer side than the first extending portion 43*a* (the position of the first extending portion 43*a* is illustrated with a two-dot-chained line m in FIG. 6A). With this configuration, a gap G1 (see FIG. 5) can be provided between the linear portion 431*e* of the terminal 4 and the front wall portion 31F or the back wall portion 31B of the outer housing 3, whereby elastic deformation of the elastic portion 43 is facilitated.

As illustrated in FIG. 6A, the second connection portion P2 between the inner fixed portion 42 (more specifically, the second base portion 42*a*) and the elastic portion 43 (more specifically, the second extending portion 43*b*) may be positioned more on the upper side than the first connection portion P1 between the outer fixed portion 41 (more specifically, the first base portion 41*a*) and the elastic portion 43 (more specifically, the first extending portion 43*a*). In the example illustrated in FIG. 6A, the second extending portion 43*b* is formed to have a substantially L shape, and includes a first linear portion 43*g* extending in the Z axis direction from the curved portion 43*c* and a second linear portion 43*f* extending in the X axis direction from a lower end of the first linear portion 43*g* (that is, an end portion in the Z2 direction). The second base portion 42*a* extends in the X axis direction from the second linear portion 43*f*. A space (see FIG. 5, the connector containing portion 21) in which the mating connector 9 (see FIG. 7) is located is provided above the second linear portion 43*f* and the second base portion 42*a*. A space E2 (see FIG. 5) in which the outer fixed portion 41 is located when the position of the inner housing 2 is misaligned in the front and back direction is provided below the second linear portion 43*f*. The second connection portion P2 is positioned at an end (an end directed in the X2 direction in the example illustrated in FIG. 6A) of the second linear portion 43*f* in the X axis direction. In other words, the second connection portion P2 is positioned at an end (an end directed in the X1 direction in the example illustrated in FIG. 6A) of the second base portion 42*a* in the X axis direction.

As illustrated in FIG. 6A, the second connection portion P2 between the second base portion 42*a* and the elastic portion 43 is disposed more on the upper side than the first connection portion P1 between the first base portion 41*a* and the elastic portion 43. Thus, the first connection portion P1 serving as the fulcrum of the elastic portion 43 is shifted from the second connection portion P2 serving as the effort of the elastic portion 43, in the Z axis direction. Thus, as indicated by the portion illustrated with a two-dot-chained line in FIG. 6A, when the elastic portion 43 is pushed in a direction toward the outer side (the X1 direction in FIG. 6A), so that the second extending portion 43*b* moves toward the first extending portion 43*a*, a moment is produced to move the first extending portion 43*a* in a lower diagonal direction (in a direction indicated by an arrow F in FIG. 6A, for example) toward the outer side. Thus, the second extending portion 43*b* can move in a direction toward the outer side, whereby the elastic portion 43 can elastically deform largely. Thus, a large tolerance can be ensured for the misalignment of the mating connector 9 to be inserted.

Figure 8:
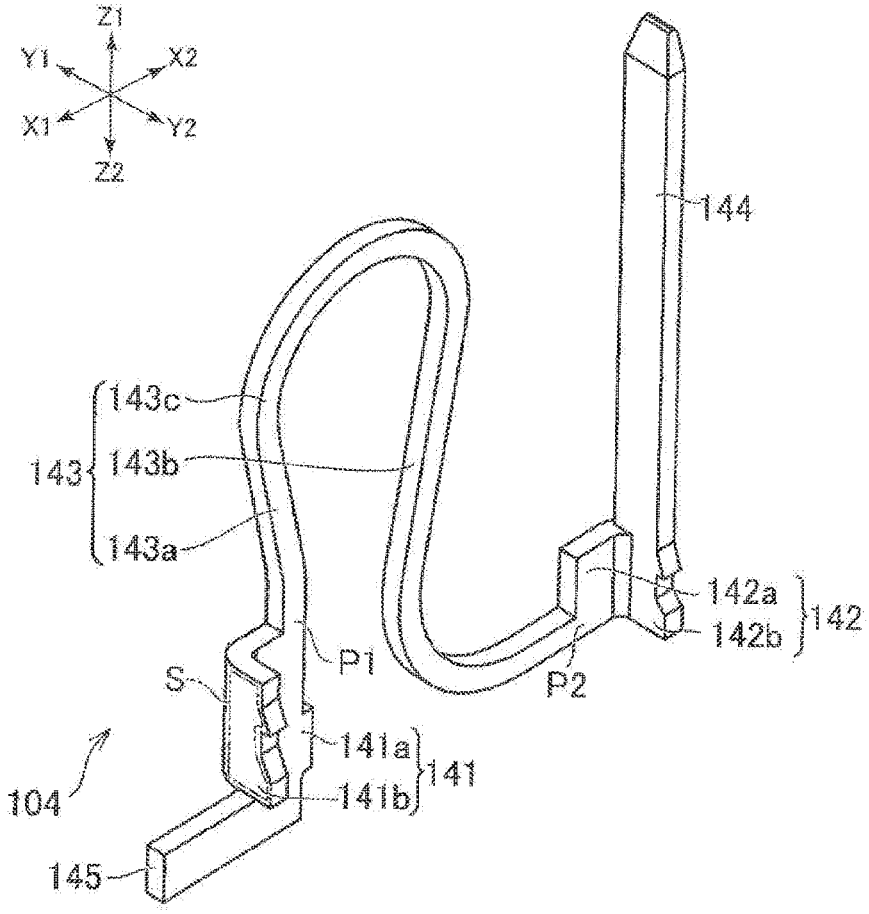
FIG. 8 is a perspective view illustrating a terminal according to a modification.

Note that the shape of the terminal 4 of the connector 1 is not necessarily limited to this. For example, as illustrated in FIG. 8, the first extending portion 43*a* may entirely extend in an upper diagonal direction toward the outer side (in the direction away from the inner housing 2). The second extending portion 43*b* may extend in an upper diagonal direction toward the center of the inner housing 2 extending in the front and back direction. Also with this configuration, a large size of the elastic portion 43 relative to the entire terminal 4 can be achieved, whereby a large tolerance can be ensured for the misalignment of the mating connector 9 to be inserted.

Like the terminal 4 described above, a terminal 104 illustrated in FIG. 8 includes an outer fixed portion 141, an inner fixed portion 142, an elastic portion 143, a contact portion 144, and a substrate-fixed portion 145. The outer fixed portion 141 includes a first base portion 141*a* and a first engaging portion 141*b*, whereas the inner fixed portion 142 includes a second base portion 142*a* and a second engaging portion 142*b*. The elastic portion 143 includes a first extending portion 143*a*, a second extending portion 143*b*, and a curved portion 143*c*. Like the terminal 4 described above, in the terminal 104, a part of the first extending portion 143*a* and a part of the curved portion 143*c* are disposed more on the outer side than a first connection portion P1 of the first base portion 141*a* and the first extending portion 143*a*. A side surface S of the first engaging portion 141*b* is disposed more on the outer side than the first extending portion 143*a*. With these features, a large size of the elastic portion 143 relative to the entire terminal 104 in the front and back direction can be achieved and the elastic portion 43 can be easily deformed elastically. Thus, a large tolerance for misalignment of the mating connector 9 to be inserted can be achieved without changing the sizes of the connector and the terminal 104.

As illustrated in FIG. 6A and FIG. 6B, the first base portion 41*a* and the second base portion 42*b* extend in the front and back direction (that is, in the X axis direction) and in the upper and lower direction (that is, in the Z axis direction). Thus, strength of the connection portion between the outer fixed portion 41 and the elastic portion 43 and strength of the connection portion between the inner fixed portion 42 and the elastic portion 43 can be reinforced. Like the terminal 4, in the terminal 104 illustrated in FIG. 8, the first base portion 141*a* and the second base portion 142*a* extend in the front and back direction (that is, in the X axis direction) and in the upper and lower direction (that is, in the Z axis direction). Thus, strength of the connection portion between the outer fixed portion 41 and the elastic portion 43 and strength of the connection portion between the inner fixed portion 42 and the elastic portion 43 can be reinforced. The terminal 104, illustrated as an example in FIG. 8, has the second base portion 142*a* being wider than the elastic portion 143 in the front and back direction and in the upper and lower direction. Thus, the strength of a connection portion P2 of the inner fixed portion 142 and the elastic portion 143 can be reinforced.

Next, a pair of supporting jigs 5 attached to the connector 1 are described. As illustrated in FIG. 1, the pair of supporting jigs 5 may be attached to the right and the left ends of the outer housing 3, so that the inner housing 2 can be movably supported relative to the outer housing 3. The left wall portion 31L and the right wall portion 31R of the outer housing 3 may each be provided with a supporting jig containing portion 33 that contains a corresponding one of the supporting jigs 5. The supporting jig containing portion 33 may be formed as a groove, a hole, or an opening extending in the upper and lower direction.

As illustrated in FIG. 4, the inner housing 2 may have protruding portions 25L and 25R respectively covering the upper sides of the left wall portion 31L and the right wall portion 31R of the outer housing 3. The protruding portions 25L and 25R may each have an upper surface provided with a first engaging protruding portion 26 protruding in the upper direction. In the present embodiment, the upper surfaces of the protruding portions 25L and 25R serve as the upper surfaces of the inner housing 2. Note that the disposed positions of the protruding portions 25L and 25R relative to the inner housing 2 is not necessarily limited to this.

The supporting jigs 5 may restrict the movement of the inner housing 2 beyond a predetermined distance in the upper and lower direction, the front and back direction, and the right and left direction. As illustrated in FIG. 1, the supporting jigs 5 may each include a main body portion 51, a base portion 52 that is a lower portion of the main body portion 51 and is contained in a corresponding one of the supporting jig containing portions 33 of the outer housing 3, and restricting portions 53F and 53B that are each connected to an upper portion of the main body portion 51 and limit the movement of the inner housing 2. As illustrated in FIG. 4, the base portion 52 may be provided with engaging portions 521 that are hooked on edges (inner surface) of the supporting jig containing portion 33. In the present embodiment, the engaging portions 521 are uneven portions formed on front and back edges of the base portion 52. Note that the shape and the disposed position of the engaging portions 521 are not necessarily limited to these, as long as the engaging portions 521 can be hooked on the outer housing 3.

In the present embodiment, the restricting portions 53F and 53B extend from the upper portion of the main body portion 51 toward the center of the inner housing 2 in the right and left direction. The restricting portions 53F and 53B are disposed above the upper surface of the inner housing 2 (more specifically, the upper surfaces of the protruding portions 25L and 25R) with a gap between the upper surface of the inner housing 2 and the restricting portions 53F and 53B. Alternatively, the restricting portions 53F and 53B may be in contact with the upper surface of the inner housing 2. The supporting jig 5 may be formed of a flat-plate-like conductive member (metal plate). The restricting portions 53F and 53B may be formed as portions bent from the main body portion 51. In the present embodiment, the upper surface of the inner housing 2 (more specifically, the upper surfaces of the protruding portions 25L and 25R) is positioned above the upper surface of the outer housing 3 (more specifically, the upper surfaces of the left wall portion 31L and the right wall portion 31R). Thus, the restricting portions 53F and 53B are also positioned above the upper surface of the outer housing 3.

As illustrated in FIG. 2, the restricting portions 53F and 53B may be respectively disposed on the front and back sides of the first engaging protruding portion 26. A gap H1 between the restricting portions 53F and 53B in the front and back direction of the restricting portions 53F and 53B is wider than a width H2 of the first engaging protruding portion 26. Thus, the movement of the inner housing 2 in the front and back direction is limited with the first engaging protruding portion 26 of the inner housing 2, moving in the front and back direction, coming into contact with the back edge of the restricting portion 53F or the front edge of the restricting portion 53B.

As illustrated in FIG. 4, the front wall portion 211F and the back wall portion 211B of the inner housing 2 may have second engaging protruding portions 27 protruding in the upper direction beyond the upper surfaces of the protruding portions 25L and 25R. The restricting portions 53F and 53B of the supporting jig 5 may be separated from the second engaging protruding portion 27 in the right and left direction. In this configuration, the movement of the inner housing 2 in the right and left direction is limited with the second engaging protruding portions 27 of the inner housing 2, moving in the right and left direction, coming into contact with distal edges of the restricting portions 53F and 53B. However, this should not be construed in a limiting sense, and the movement of the inner housing 2 in the right and left direction may be limited with the left end of the protruding portion 25L on the left side or the right end of the protruding portion 25R on the right side coming into contact with the main body portion 51 of the supporting jig 5.

As illustrated in FIG. 1 and FIG. 4, the first and the second engaging protruding portions 26 and 27 may be respectively provided with inclined surfaces 261 and 271. The inclined surfaces 261 and 271 are surfaces extending in a lower diagonal direction toward the connector containing portion 21. As illustrated in FIG. 2, the inclined surface 261 formed on the first engaging protruding portion 26 may have a width H3 in the right and left direction of the inclined surface 261 larger than a movable distance of the inner housing 2 in the right and left direction. Similarly, the inclined surface 271 formed on the second engaging protruding portion 27 may have a width H4 in the front and back direction larger than a movable distance of the inner housing 2 in the front and back direction. With this configuration, for example, even when the amount of relative misalignment between the connector 1 and the mating connector 9 is equal to the upper limit of the movable amount of the inner housing 2, the mating connector 9 can be certainly guided to be inserted, so that the mating connector 9 can be fit to the connector 1.

In the example illustrated in FIG. 1 and FIG. 4, the supporting jigs 5 restrict the movement of the inner housing 2 beyond the predetermined distance in the three directions (the upper and lower direction, the front and back direction, and the right and left direction). Alternatively, the inner housing 2 may be fixed by the supporting jigs 5 to be unmovable in one or a plurality of the upper and lower direction, the front and back direction, and the right and left direction. For example, by making the distance between the restricting portions 53F and 53B and the upper surface of the inner housing 2 (more specifically, the upper surfaces of the protruding portions 25L and 25R) substantially zero in the upper and lower direction, the inner housing 2 can be fixed in the upper and lower direction. By making the distance between the restricting portions 53F and 53B and the first engaging protruding portion 26 substantially zero in the front and back direction, the inner housing 2 can be fixed in the front and back direction. By making the distance between the restricting portions 53F and 53B and the second engaging protruding portion 27 substantially zero in the right and left direction, the inner housing 2 can be fixed in the right and left direction. In other words, the supporting jigs 5 may enable the inner housing 2 to move by a predetermined distance only in one or two of the upper and lower direction, the front and back direction, and the right and left direction.

Figure 9:
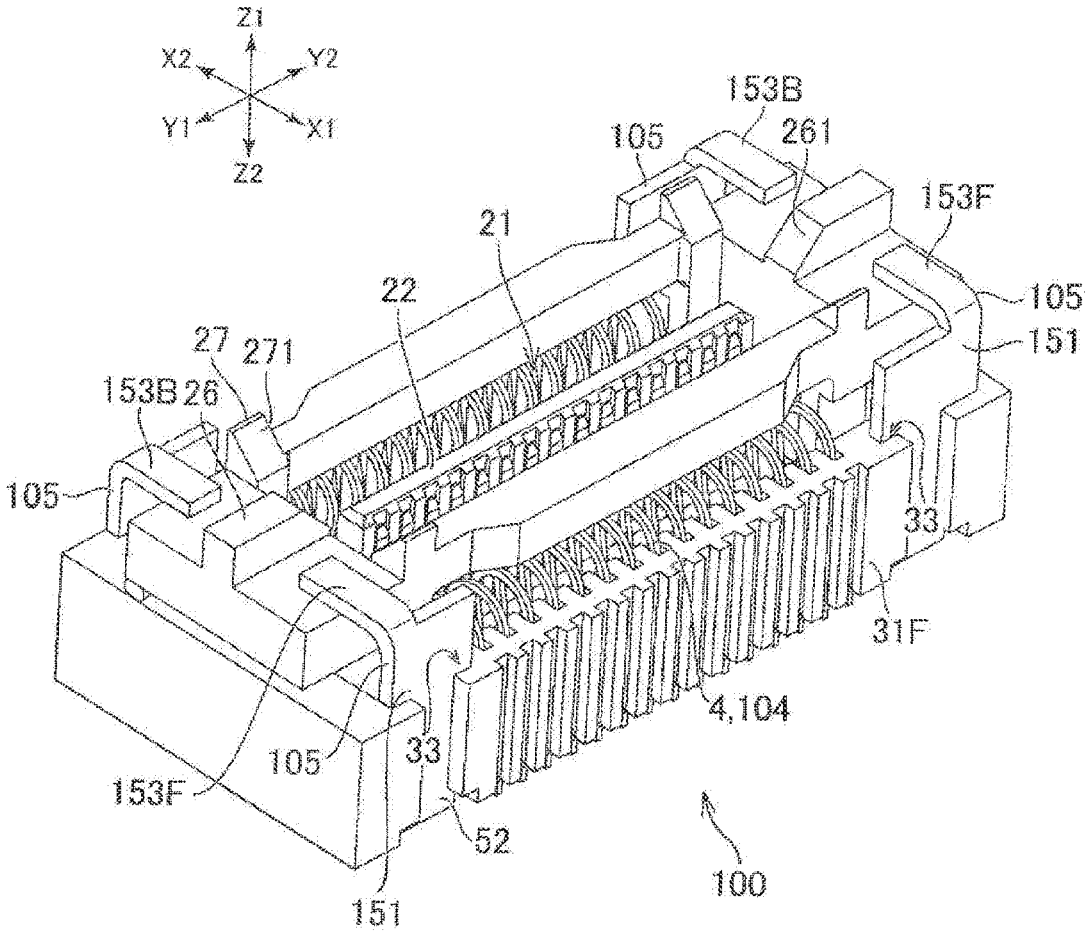
FIG. 9 is a perspective view illustrating a connector according to a modification.
Figure 10:
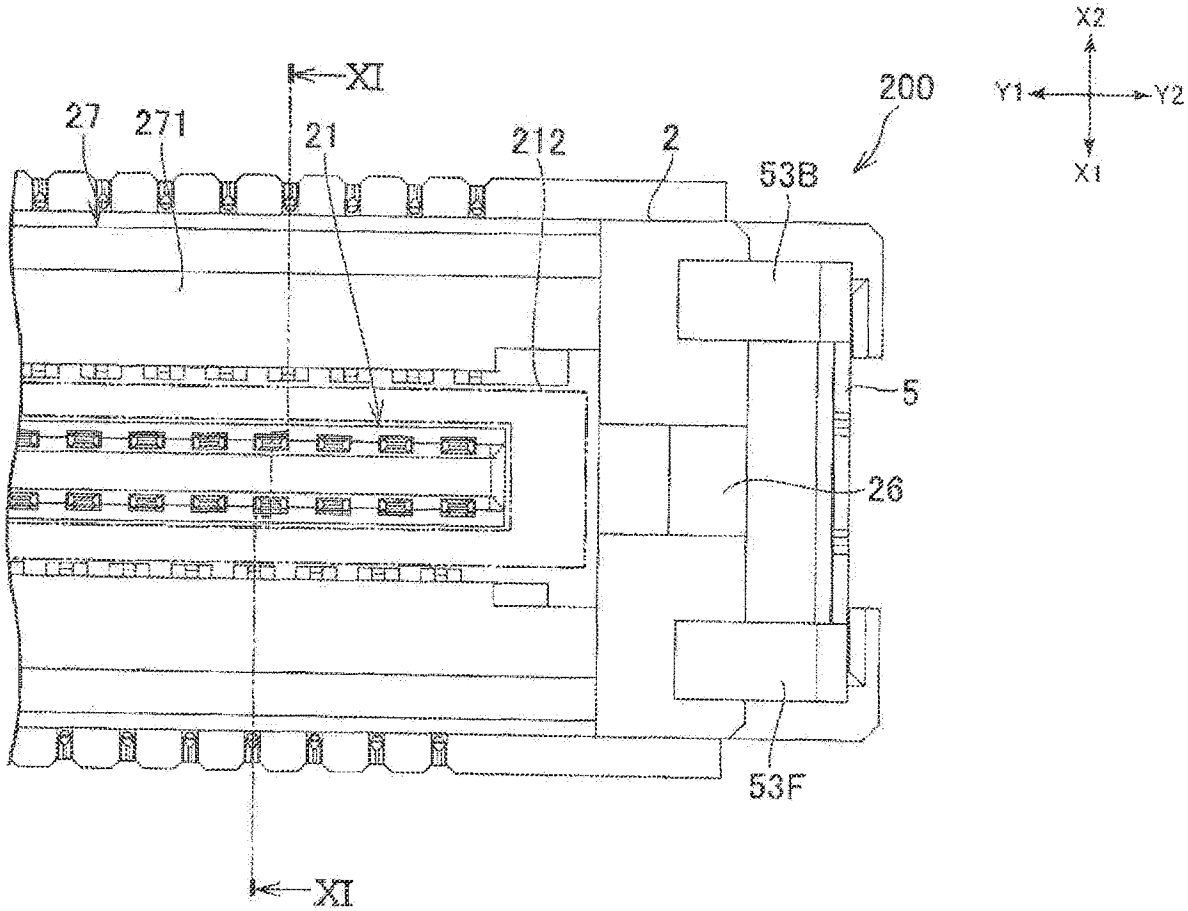
FIG. 10 is a plan view illustrating a connector according to another modification.

Note that the shape and the disposed position of the supporting jigs 5 of the connector 1 are not necessarily limited to these. For example, in the connector 100 illustrated in FIG. 9, a supporting jig 105 may be contained in each of four supporting jig containing portions 33 including two containing portions on the left and the right sides of the front wall portion 31F of the outer housing 3 and two containing portions on the left and the right sides of the back wall portion (wall portion on the side opposite to the front wall portion 31F). In this configuration, the supporting jig 105 contained in the front wall portion 31F may include a restricting portion 153F extending toward the back side from the main body portion 151. The supporting jig 105 contained in the back wall portion may include a restricting portion 153B extending toward the front side from the main body portion 151. Also with this configuration, when the inner housing 2 moves in the front and back direction, the first engaging protruding portion 26 comes into contact with the distal edge of the restricting portion 153F or the restricting portion 153B, whereby the movement of the inner housing 2 in the front and back direction can be limited. Furthermore, when the inner housing 2 moves in the right and left direction, the second engaging protruding portion 27 comes into contact with the side edge of the restricting portion 153F or 153B, whereby the movement of the inner housing 2 in the right and left direction can be limited.

FIG. 10, FIG. 11, FIG. 12A, and FIG. 12B illustrate a connector 200 according to another modification. In these drawings, the same components as those in the connector 1 described above are denoted with the same reference numerals. Differences from the connector 1 are mainly described below. Matters of the connector 200 not described below are the same as those in the connector 1.

Figure 11:
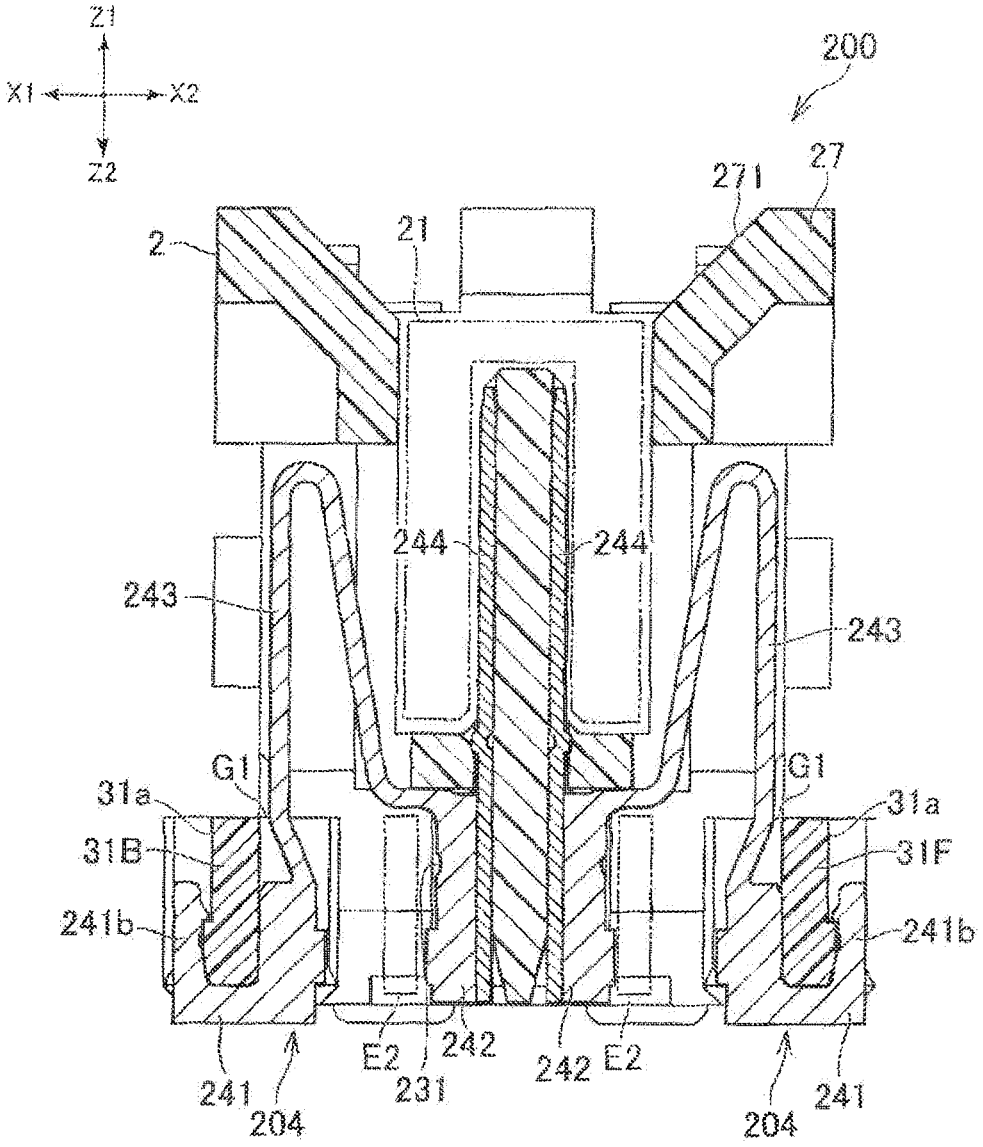
FIG. 11 is a cross-sectional view taken along line XI-XI in FIG. 10.
Figure 12A:
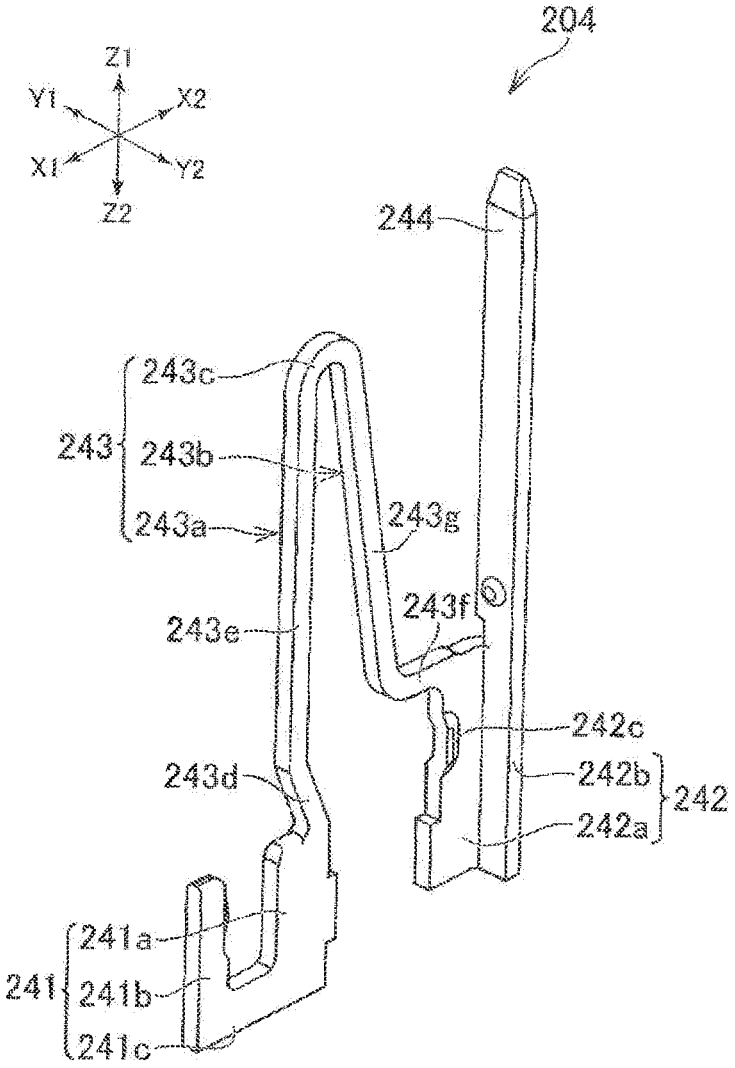
FIG. 12A is a perspective view illustrating a terminal included in the connector illustrated in FIG. 10.

The connector 200 includes terminals 204 (see FIG. 11). As illustrated in FIG. 12A, the terminals 204 each include an outer fixed portion 241, an inner fixed portion 242, an elastic portion 243, and a contact portion 244.

As illustrated in FIG. 12A, the outer fixed portion 241 includes a first base portion 241*a*, a first engaging portion 241*b*, and a substrate-fixed portion 241*c*. In the example of the connector 200, the substrate-fixed portion 241*c* extends outward in the front and back direction from the lower portion of the first base end 241*a*, to be positioned at the lower end of the terminal 204.

In other words, the substrate-fixed portion 241*c* extends toward the front side from the lower portion of the first base end 241*a*, in the front side terminal 204. The substrate-fixed portion 241*c* extends toward the back side from the lower portion of the first base end 241*a*, in the back side terminal 204. The first engaging portion 241*b* extends toward the upper side from the front portion of the substrate-fixed portion 241*c*, in the back side terminal 204. The first engaging portion 241*b* extends toward the upper side from the back portion of the substrate-fixed portion 241*c*, in the back side terminal 204. Thus, the outer fixed portion 241 has a substantially U shape with the upper side open, as viewed in the right and left direction. A protruding portion 241*d* (see FIG. 12B) to be hooked on a groove 31*a*, formed on a lower portion (wall portion 31B and 31F) of the outer housing 3, is formed on an edge of the first engaging portion 241*b* (edge on the side of the first base portion 241*a*).

As illustrated in FIG. 12A, the inner fixed portion 242 includes a second base portion 242*a* connected to the elastic portion 243 and a portion that is bent relative to the second base portion 242*a* (the portion 242*b* is referred to as "bent portion"). The terminal 204 is different from the terminal 4 in that the second base portion 242*a* functions as an engaging portion to be hooked on the inner housing 2. More specifically, a protruding portion 242*c*, protruding in the thickness direction (right and left direction) of the second base portion 242*a*, is formed on the second base portion 242*a*, and the protruding portion 242*c* is hooked on the inner surface of a groove (terminal containing portion 231) formed on a lower portion of the inner housing 2. The contact portion 244 extends toward the upper side from the bent portion 242*b*.

As illustrated in FIG. 12A, the elastic portion 243 includes a portion (first extending portion 243*a*) extending toward the upper side from the outer fixed portion 241, a portion (second extending portion 243*b*) extending toward the upper side from the inner fixed portion 242, and a curved portion 243*c* that is curved between the first extending portion 243*a* and the second extending portion 243*b* to have an arch shape. In the example of the terminal 204, the second extending portion 243*b* includes a second linear portion 243*f* extending in the front and back direction from the inner fixed portion 242 (a portion extending in the front and back direction toward the first extending portion 243*a*) and a first linear portion 243*g* extending toward the upper side as a result of bending at an end portion of the second linear portion 243*f*. A space (see FIG. 11, the connector containing portion 21) in which the mating connector 9 (see FIG. 7) is located is provided above the second linear portion 243*f*. A space E2 (see FIG. 11) in which the outer fixed portion 241 is located when the position of the inner housing 2 is misaligned in the front and back direction is provided below the second linear portion 243*f*.

Figure 12B:
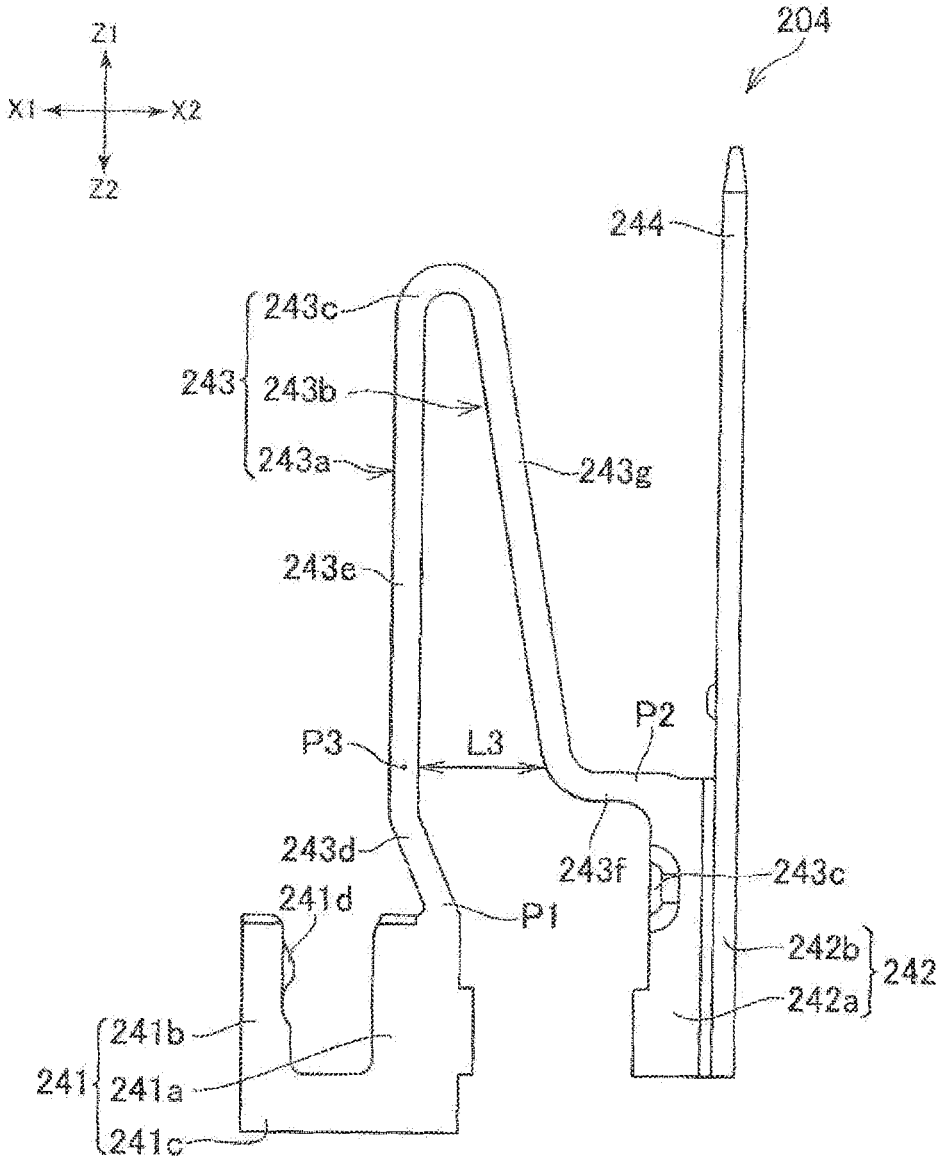
FIG. 12B is a side view illustrating the terminal illustrated in FIG. 12A.

As illustrated in FIG. 12B, the example of the terminal 204 is different from the example of the terminal 4 in that the first linear portion 243*g* diagonally extends toward the upper side and outer side in the front and back direction. Specifically, in the front side terminal 204, the first linear portion 243*g* diagonally extends toward the front side and the upper side from the second linear portion 243*f*. In the back side terminal 204, the first linear portion 243*g* diagonally extends toward the back side and the upper side from the second linear portion 243*f*. With this configuration, the curved portion 243*c* can be prevented from entering the connector containing portion 21, when the inner housing 2 is misaligned in the front and back direction. For example, the curved portion 243*c* can be prevented from entering the connector containing portion 21 due to the first linear portion 243*g* inclining toward the back side.

As illustrated in FIG. 12B, the terminal includes a first connection portion P1 that is a connection portion between the first extending portion 243*a* and the outer fixed portion 241 and a second connection portion P2 that is a connection portion between the second extending portion 243*b* and the inner fixed portion 242. The second connection portion P2 is positioned more on the upper side than the first connection portion P1, as in the example of the terminal 4.

As illustrated in FIG. 12B, the first extending portion 243*a* has a portion P3 positioned more on the front or back side than the second connection portion P2 (the portion P3 is a portion positioned at the same height as the second connection portion P2). Specifically, the portion P3 is located more on the front side than the second connection portion P2 in the terminal 204 positioned on the front side, whereas the portion P3 is located more on the back side than the second connection portion P2 in the terminal 204 positioned on the back side. The portion P3 is located more on the outer side in the front and back direction than the first connection portion P1. Specifically, the portion P3 is located more on the front side than the first connection portion P1 in the terminal 204 positioned on the front side, whereas the portion P3 is located more on the back side than the first connection portion P1 in the terminal 204 positioned on the back side. With this configuration, a distance L3 between the first extending portion 243*a* and the second extending portion 243*b* can be increased. This allows for a larger shift of the inner housing 2 in the front and back direction.

As illustrated in FIG. 12B, in the example of the terminal 204, the first extending portion 243*a* includes an inclined portion 243*d* extending from the first connection portion P1 and a linear portion 243*e* that further extends from the inclined portion 243*d*. The inclined portion 243*d* diagonally extends toward the outer side in the front and back direction and toward the upper side. Specifically, the inclined portion 243*d* of the terminal 204 positioned on the front side diagonally extends toward the front side and toward the upper side, and the inclined portion 243*d* of the terminal 204 positioned on the back side extends diagonally toward the back side and the upper side. The portion P3 is located more on the outer side in the front and back direction than the first connection portion P1, due to the inclined portion 243*d*. The first extending portion 243*a* is bent between the linear portion 243*e* and the inclined portion 243*d*. The linear portion 243*e* extends toward the upper side from the inclined portion 243*d* (in the vertical direction).

As illustrated in FIG. 12B, in the example of the terminal 204, the inclined portion 243*d* has an upper end (a bend portion between the inclined portion 243*d* and the linear portion 243*e*) positioned more on the lower side than the second connection portion P2 (in other words, more on the lower side than the second linear portion 2430. Specifically, the inclined portion 243*d* has the upper end at a height lower than that of the second connection portion P2. This configuration ensures a gap G1 (see FIG. 11) between the first extending portion 243*a* of the front side terminal 204 and the front wall portion 31F of the outer housing 3, and ensures a gap G1 (see FIG. 11) between the first extending portion 243*a* of the back side terminal 204 and the back wall portion 31B. Thus, deformation of the elastic portion 243 in the front and back direction is enabled without being hindered by the wall portion 31F or 31B. The inclined portion 243*d* may have the upper end positioned at the same height as the second connection portion P2. The inclined portion 243*d* may have the upper end positioned more on the front side or the back side than the second connection portion P2.

The shape of the terminal 204 is not limited to that illustrated in FIG. 12A and the like. For example, the terminal 204 may have a substantially L shaped portion extending toward the upper side from the first connection portion P1 and is bent to extend toward the outer side in the front and back direction. Specifically, the terminal 204 positioned on the front side may have a substantially L shaped portion that extends toward the upper side from the first connection portion P1, and is bent to extend toward the front side. Specifically, the terminal 204 positioned on the back side may have a substantially L shaped portion that extends toward the upper side from the first connection portion P1, and is bent to extend toward the back side. The first extending portion 243*a* may extend toward the upper side from the substantially L shaped portion.

Note that the present disclosure according to the present specification is only one example, and thus any appropriate change that preserves the gist of the present disclosure and can easily be conceived by a person skilled in the art is within the scope of the present disclosure. Furthermore, the width, thickness, shape, and the like of each part illustrated in the drawings are schematically expressed, and are not limited to the interpretation of the present disclosure.

The invention claimed is:

1. A terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion, the first connection portion being positioned at the upper edge of the first fixed portion; and a second connection portion which connects the base portion of the second fixed portion to a second end of the second extending portion of the elastic portion, the second connection portion being positioned at the front edge of the base portion of the second fixed portion, wherein the first connection portion is positioned closer to the lower edge of the first fixed portion in the up-down direction as compared to the second connection portion, wherein the second connection portion is positioned closer to the lower edge of the first fixed portion in the up-down direction as compared to the curved portion of the elastic portion, and wherein the first extending portion of the elastic portion has an inclined portion and a linear portion, the inclined portion includes the second end of the first extending portion and extends diagonally to the front and up, in the front-back direction and the up-down direction, respectively, from the first connection portion to the linear portion, and the linear portion includes the first end of the first extending portion and extends downwardly, in the up-down direction, from the curved portion of the elastic portion to the inclined portion, whereby a bend is defined at a connection of the inclined portion and the linear portion.

2. The terminal according to claim 1, wherein the bend is positioned between the first connection portion and the second connection portion in the up-down direction.

3. The terminal according to claim 1, wherein the base portion of the second fixed portion extends from a left side thereof to a right side thereof in a left-right direction, wherein the second fixed portion has a protruding portion which protrudes from each of the left and right sides of the base portion of the second fixed portion in the left-right direction.

4. The terminal according to claim 3, wherein the protruding portion is positioned between the second connection portion and the lower edge of the base portion of the second fixed portion in the up-down direction.

5. The terminal according to claim 3, wherein the protruding portion is positioned at or proximate to the front edge of the base portion of the second fixed portion.

6. The terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion, the first connection portion being positioned at the upper edge of the first fixed portion; and a second connection portion which connects the base portion of the second fixed portion to a second end of the second extending portion of the elastic portion, the second connection portion being, positioned at the front edge of the base portion of the second fixed portion, wherein the first connection portion is positioned closer to the lower edge of the first fixed portion in the up-down direction as compared to the second connection portion, wherein the second connection portion is positioned closer to the lower edge of the first fixed portion in the up-down direction as compared to the curved portion of the elastic portion, wherein the base portion of the second fixed portion extends from a left side thereof to a right side thereof in a left-right direction, wherein the second fixed portion has a protruding portion which protrudes from each of the left and right sides of the base portion of the second fixed portion in the left-right direction, wherein the protruding portion is positioned at or proximate to the front edge of the base portion of the second fixed portion, and wherein the second fixed portion has a bent portion which is bent in a perpendicular manner relative to the base portion.

7. The terminal according to claim 6, further comprising a contact portion, the contact portion extending up from the bent portion in the up-down direction.

8. A terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion, the first connection portion being positioned at the upper edge of the first fixed portion; and a second connection portion which connects the base portion of the second fixed portion to a second end of the second extending portion of the elastic portion, the second connection portion being positioned at the front edge of the base portion of the second fixed portion, wherein the first connection portion is positioned closer to the lower edge of the first fixed portion in the up-down direction as compared to the second connection portion, and wherein the second connection portion is positioned closer to the lower edge of the first fixed portion in the up-down direction as compared to the curved portion of the elastic portion, and wherein the second fixed portion has a bent portion which is bent in a perpendicular manner relative to the base portion.

9. The terminal according to claim 8, further comprising a contact portion, the contact portion extending up from the bent portion in the up-down direction.

10. The terminal according to claim 8, wherein the first fixed portion has a base portion and a substrate-fixed portion, the base portion defining the upper edge of the first fixed portion, the substrate-fixed portion defining the lower edge of the first fixed portion, whereby the base portion is positioned between the first connection portion and the substrate-fixed portion in the up-down direction.

11. The terminal according to claim 8, wherein the lower edge of the first fixed portion extends in the front-back direction from the front edge of the first fixed portion to the back edge of the first fixed portion such that a first corner portion is provided where the lower edge of the first fixed portion meets the front edge of the first fixed portion and such that a second corner portion is provided where the lower edge of the first fixed portion meets the back edge of the first fixed portion, and wherein the first connection portion is provided, in the front-back direction, between the first corner portion and the second corner portion.

12. A connector comprising the first housing, the second housing and the terminal of claim 8.

13. A connector assembly comprising a mating connector and the connector of claim 12.

14. A The terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction, the first fixed portion has a base portion and a substrate-fixed portion, the base portion defining the upper edge of the first fixed portion, the substrate-fixed portion defining the lower edge of the first fixed portion;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion; and a second connection portion which connects the base portion of the second fixed portion to a second end of the second extending portion of the elastic portion, wherein the first connection portion is positioned closer to the lower edge of the first fixed portion in the up-down direction as compared to the second connection portion, wherein the second connection portion is positioned closer to the lower edge of the first fixed portion in the up-down direction as compared to the curved portion of the elastic portion, wherein the base portion of the first fixed portion is positioned between the first connection portion and the substrate-fixed portion in the up-down direction, and wherein the first extending portion of the elastic portion has an inclined portion and a linear portion, the inclined portion includes the second end of the first extending portion and extends diagonally to the front and up, in the front-back direction and the up-down direction, respectively, from the first connection portion to the linear portion, and the linear portion includes the first end of the first extending portion and extends downwardly, in the up-down direction, from the curved portion of the elastic portion to the inclined portion, whereby a bend is defined at a connection of the inclined portion and the linear portion.

15. The terminal according to claim 14, wherein the bend is positioned between the first connection portion and the second connection portion in the up-down direction.

16. The terminal according to claim 14, wherein the base portion of the second fixed portion extends from a left side thereof to a right side thereof in a left-right direction, wherein the second fixed portion has a protruding portion which protrudes from each of the left and right sides of the base portion of the second fixed portion in the left-right direction.

17. The terminal according to claim 16, wherein the protruding portion is positioned between the second connection portion and the lower edge of the base portion of the second fixed portion in the up-down direction.

18. The terminal according to claim 16, wherein the protruding portion is positioned at or proximate to the front edge of the base portion of the second fixed portion.

19. The terminal according to claim 16, wherein the lower edge of the first fixed portion extends in the front-back direction from the front edge of the first fixed portion to the back edge of the first fixed portion such that a first corner portion is provided where the lower edge of the first fixed portion meets the front edge of the first fixed portion and such that a second corner portion is provided where the lower edge of the first fixed portion meets the back edge of the first fixed portion, and wherein the first connection portion is provided, in the front-back direction, between the first corner portion and the second corner portion.

20. A connector comprising the first housing, the second housing and the terminal of claim 16.

21. A connector assembly comprising a mating connector and the connector of claim 20.

22. A terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction, the first fixed portion has a base portion and a substrate-fixed portion, the base portion defining the upper edge of the first fixed portion, the substrate-fixed portion defining the lower edge of the first fixed portion;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion; and a second connection portion which connects the base portion of the second fixed portion to a second end of the second extending portion of the elastic portion, wherein the first connection portion is positioned closer to the lower edge of the first fixed portion in the up-down direction as compared to the second connection portion, wherein the second connection portion is positioned closer to the lower edge of the first fixed portion in the up-down direction as compared to the curved portion of the elastic portion, wherein the base portion of the first fixed portion is positioned between the first connection portion and the substrate-fixed portion in the up-down direction, wherein the base portion of the second fixed portion extends from a left side thereof to a right side thereof in a left-right direction, wherein the second fixed portion has a protruding portion which protrudes from each of the left and right sides of the base portion of the second fixed portion in the left-right direction, wherein the protruding portion is positioned at or proximate to the front edge of the base portion of the second fixed portion, and wherein the second fixed portion has a bent portion which is bent in a perpendicular manner relative to the base portion.

23. The terminal according to claim 22, further comprising a contact portion, the contact portion extending up from the bent portion in the up-down direction.

24. A terminal configured to couple a first housing to a second housing to form a connector, the terminal comprising:

a first fixed portion which is configured to be fixed to the first housing, the first fixed portion extending from a lower edge thereof to an upper edge thereof in an up-down direction and extending from a front edge thereof to a back edge thereof in a front-back direction, wherein the up-down direction is perpendicular to the front-back direction, the first fixed portion has a base portion and a substrate-fixed portion, the base portion defining the upper edge of the first fixed portion, the substrate-fixed portion defining the lower edge of the first fixed portion;

a second fixed portion which is configured to be fixed to the second housing, the second fixed portion having a base portion extending from a lower edge thereof to an upper edge thereof in the up-down direction and extending from a front edge thereof to a back edge thereof in the front-back direction;

an elastic portion, the elastic portion having a first extending portion, a second extending portion and a curved portion which connects first ends of the first and second extending portions;

a first connection portion which connects the first fixed portion to a second end of the first extending portion of the elastic portion; and a second connection portion which connects the base portion of the second fixed portion to a second end of the second extending portion of the elastic portion, wherein the first connection portion is positioned closer to the lower edge of the first fixed portion in the up-down direction as compared to the second connection portion, and wherein the second connection portion is positioned closer to the lower edge of the first fixed portion in the up-down direction as compared to the curved portion of the elastic portion, and wherein the base portion of the first fixed portion is positioned between the first connection portion and the substrate-fixed portion in the up-down direction, and wherein the second fixed portion has a bent portion which is bent in a perpendicular manner relative to the base portion.

25. The terminal according to claim 24, further comprising a contact portion, the contact portion extending up from the bent portion in the up-down direction.

* * * * *